US005452567A

United States Patent [19]

Lieder

[11] Patent Number: 5,452,567

[45] Date of Patent: Sep. 26, 1995

[54] DUAL BAG FILLING APPARATUS

[75] Inventor: Gaylerd M. Lieder, Crystal, Minn.

[73] Assignee: Bemis Company, Inc., Minneapolis, Minn.

[21] Appl. No.: 24,385

[22] Filed: Mar. 1, 1993

[51] Int. Cl.[6] ..... B65B 43/26

[52] U.S. Cl. ..... 53/570; 53/284.7; 53/386.1; 53/571; 141/166; 141/313

[58] Field of Search ..... 141/10, 114, 166, 141/313; 53/284.7, 384.1, 386.1, 459, 469, 570, 571, 573

[56] References Cited

U.S. PATENT DOCUMENTS

| | | | |
|---|---|---|---|
| 1,909,319 | 5/1933 | Taylor . | |
| 2,097,447 | 11/1937 | Cundall et al. | 53/469 |
| 2,585,335 | 2/1952 | McHale et al. | 53/570 X |
| 2,853,842 | 9/1958 | Vredenburg . | |
| 3,192,096 | 6/1965 | Rhine . | |
| 3,469,367 | 9/1969 | Ayres et al. . | |
| 3,673,759 | 7/1972 | Ayres et al. | 53/459 |
| 3,676,977 | 7/1972 | Rothmann et al. | 53/459 X |
| 3,750,721 | 8/1973 | Hudson | 53/386.1 X |
| 3,830,266 | 8/1974 | Hudson | 141/114 X |
| 3,945,173 | 3/1976 | Buzzi | 53/571 |
| 4,074,507 | 2/1978 | Ruf et al. | 53/570 X |
| 4,078,358 | 3/1978 | Henderson | 53/459 |
| 4,098,054 | 7/1978 | Cerioni . | |
| 4,432,186 | 2/1984 | McGregor | 53/284.7 X |
| 4,561,238 | 12/1985 | Odom . | |
| 4,612,965 | 9/1986 | McGregor | 53/571 X |

FOREIGN PATENT DOCUMENTS

| | | | |
|---|---|---|---|
| 758379 | 10/1956 | United Kingdom | 53/284.7 |

*Primary Examiner*—John Sipos
*Assistant Examiner*—Daniel Moon
*Attorney, Agent, or Firm*—Clayton R. Johnson

[57] ABSTRACT

Two bag pick up assemblies and a feed assembly pick up two bags at a time from two bag stacks and direct the bags to a bag positioner assembly. The positioner assembly moves the bags to a nearly vertical position in longitudinal alignment to be conveyingly engaged at the top edge portions and conveyed beneath hopper spout assemblies whereat hanger assemblies clampingly engage bag top corner portions and dependingly support the bags. Bag top side wall portions of the clamped bags extending above the members are spread by vacuum cups on conveyor members. Spout jaws move downwardly between the spread side wall portions. The conveyor members move from a chain closed position to a chain open position as product is discharged through the opening jaws to open the clamped bags. The hanger assemblies move the corner portion to close the filled bags and the conveyor members move to their chain closed position to conveyingly engage the filled bags and in conjunction with the bottom conveyor convey the filled bags to transfer stations conveyors which are driven at a slower rate of speed than the conveyor members when the conveyor members are being driven and out of their chain open position and at the same higher rate of speed as the conveyor member when the conveyor members are being driven.

21 Claims, 19 Drawing Sheets

| | | |

DUAL BAG FILLING APPARATUS

BACKGROUND OF THE INVENTION

A machine for picking up a flat folded bag, opening the bag and filling the bag.

In U.S. Pat. No. 4,561,238 to Odom there is disclosed a machine for picking up, opening, filling and closing a bag, said machine including a bag positioner assembly for receiving a flat folded bag and supporting it in a position to be gripped by a spout carriage assembly. The carriage assembly opens the bag and moves it horizontally to a filling station where the bag is filled.

In order to provide improvements in machines for filling bags, including at high speeds, and reducing the discharge of dust into the ambient atmosphere, this invention has been made.

SUMMARY OF THE INVENTION

Two bag pick up assemblies in longitudinal side by side relationship are operable for picking up flat folded bags from adjacent stacks on a magazine and transferring the picked up bags longitudinally adjacent bag positioners. The positioner assemblies move the bags to have their top edge portions engaged by and transferred to a bag filling station by a first bag top endless conveyor assembly to a second bag top endless conveyor assembly to be moved thereby to positions for engagement by adjacent bag hanger assemblies to be supported thereby as spout flaws move As the laws open, the part off the bag below the second bag top conveyor assembly is opened by the discharge of product. The the filled bags at the bag filling station are supported in part by the second conveyor assembly and in part by a bag bottom conveyor assembly which move the bags to a transfer station there the bags are received by and moved forwardly by transfer bag top and bottom conveyor assemblies to a bag closure station (bag sealer machine).

One of the objects of the invention is to provide new and novel means for picking up flat folded bags and filling the bags at a relatively high rate of speed. In furtherance of the above object, another object of this invention is to provide new and novel means for picking up and feeding two bags at a time to be transferred to a bag filling station where the two bags are filled at the same time. Still another object of this invention is to provide new and novel means for opening and filling a bag while minimizing discharge of particles into the ambient atmosphere.

BRIEF DESCRIPTION OF THE DRAWINGS

FIG. 26 is a sequence chart showing the sequence of operation of various assemblies and components;

Figure 1:
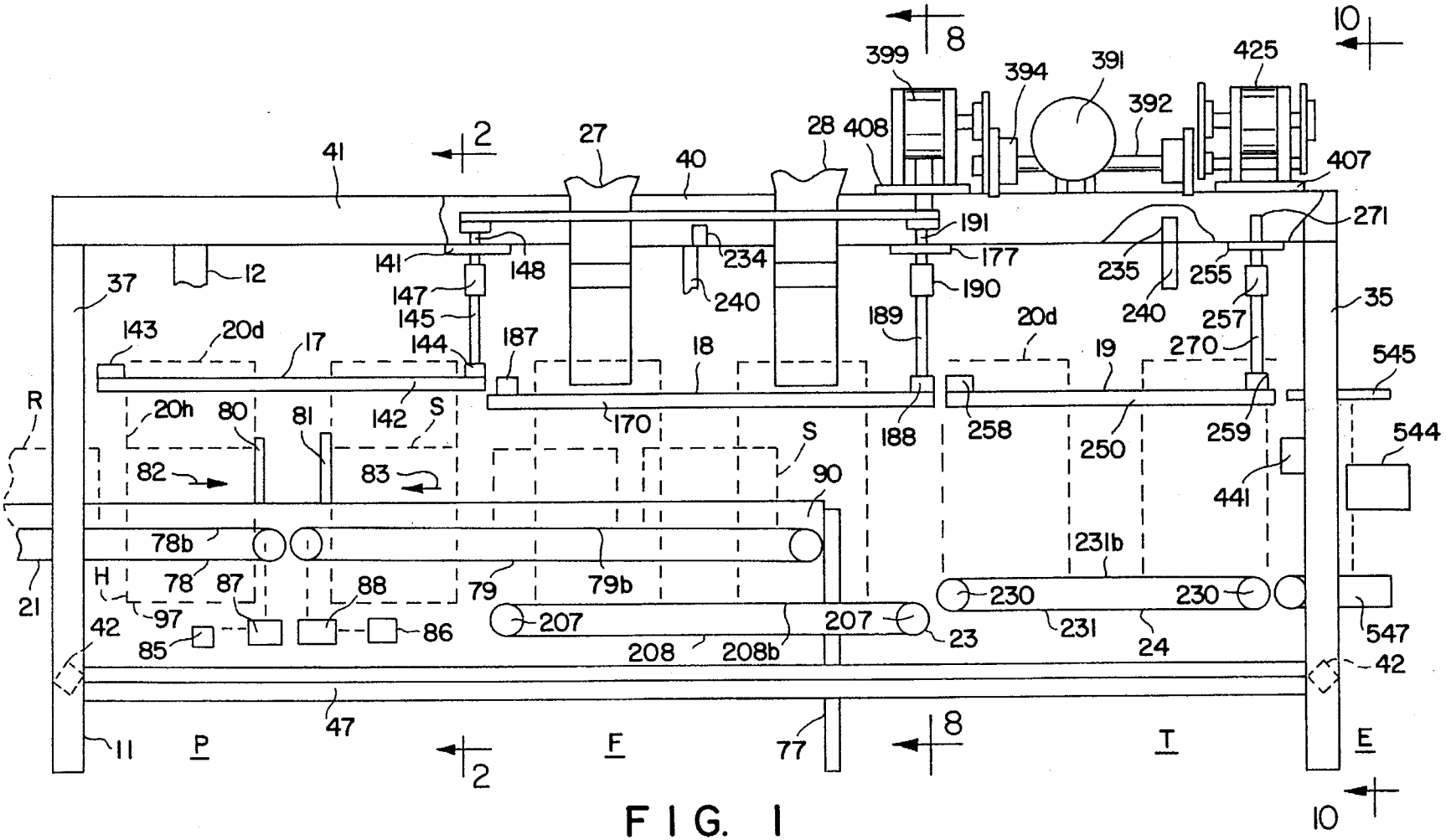
FIG. 1 is a somewhat diagrammatic side view of the apparatus of this invention with many parts not being shown.
Figure 2:
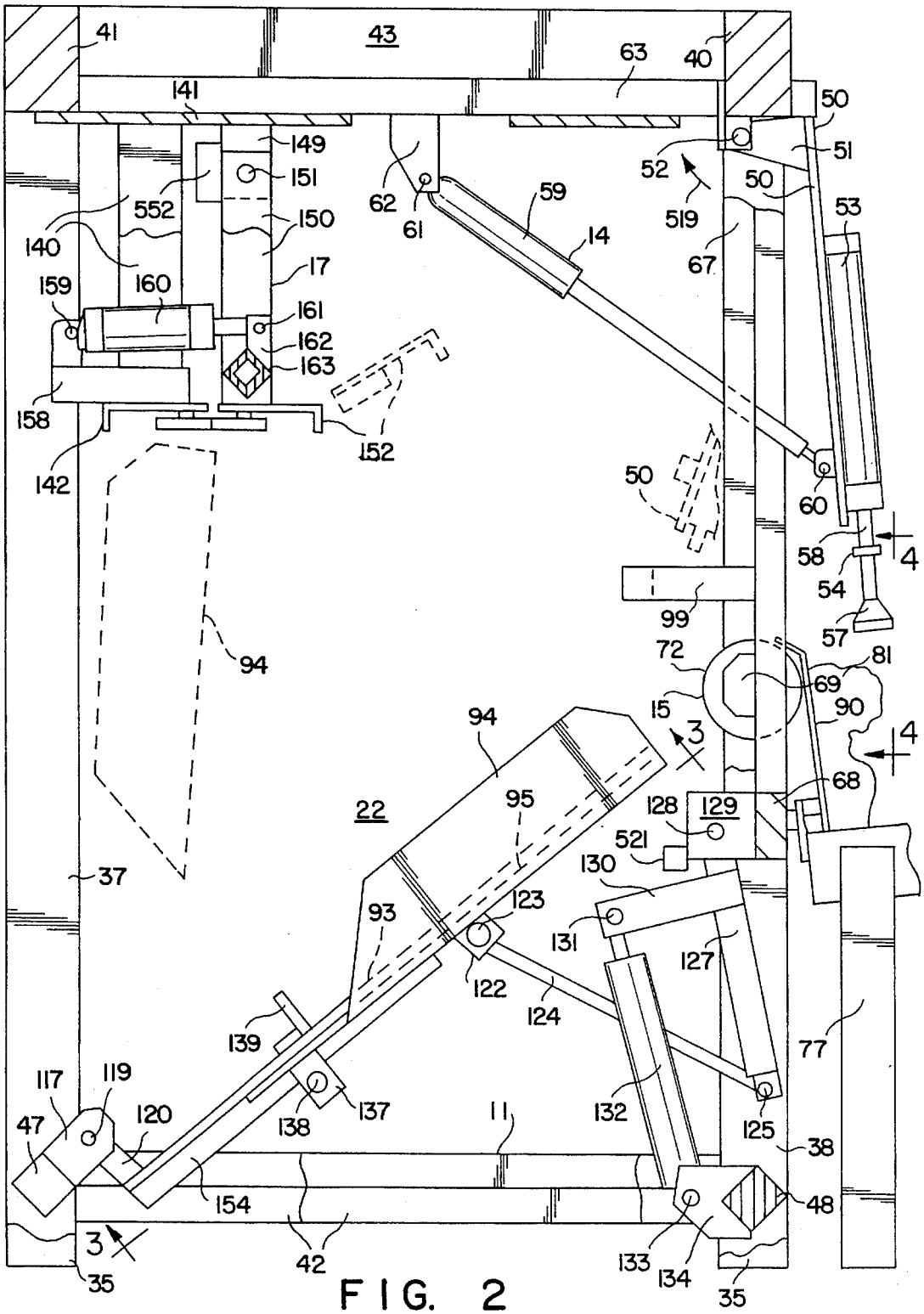
FIG. 2 is a transverse cross sectional view showing the bag pick up, the bag positioner and the associated bag top conveyor assemblies in their datum positions in solid lines and the assemblies in other positions in dotted lines, said view being generally taken along the line and in the direction of the arrows 2—2 of FIG. 1 with various parts being broken away and other parts not being shown.
Figure 10:
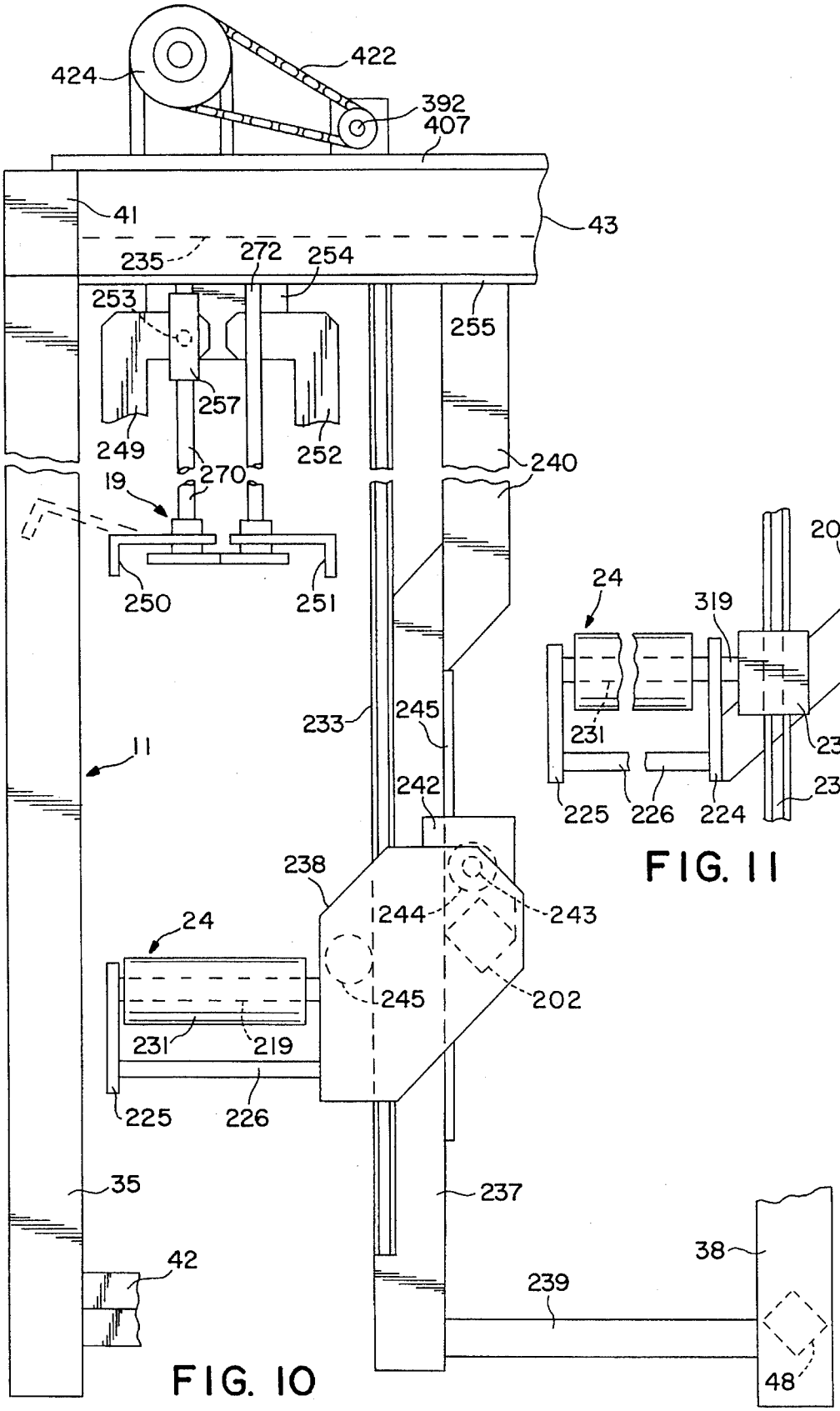
FIG. 10 is a transverse end view that is generally taken along the line and in the direction of the arrows 10—10 of FIG. 1 with various parts being broken away and other parts not being shown, said view showing the filled bag transfer station bag top and bag bottom conveyor assemblies.

Referring in particular to FIGS. 1, 2 and 10, the apparatus of this invention includes a main frame 11; a pair of bag pick up assemblies 12, 14 (see FIG. 4) on the frame for picking up the top bag 20*c* (FIG. 5) from the respective one of vertical stacks R, S of horizontal, flat folded paper or plastic (gusseted or non-gusseted) bags 20 on the bag magazine 21; a bag feeder assembly 15 for feeding a pair of folded bags to the bag positioner assembly 22 to be aligned for being conveyingly engaged by the bag top conveyor assembly 17 which is located at the positioner station P; a bag top edge conveyor assembly 18 at the feeding station F for receiving flat folded bags from the conveyor assembly 17 and conveying them beneath hopper spout assemblies 27, 28, and after the bags are filled, cooperating with bag filling station bag bottom conveyor assembly 23; bag hanger assemblies 25, 30 at the filling station F to respectively support the bag top edge portions of a bag in an elevated condition just before and during the discharge of product from the hopper spout assemblies; and bag top and bag bottom conveyor assemblies 19, 24 respectively at the transfer station T for receiving the filled bags from the conveyor assemblies 18, 23 and conveying them to a discharge station E; each of the above numeral designations except reference number 20 being generally designated. The main frame includes front uprights 35; rear uprights 37, 38; upper longitudinal frame members 40, 41 extending between the respective pair of uprights and joined thereto; transverse upper front and rear frame members 43 joined to the respective pair of uprights; lower front and rear transverse channels 42 joined to the respective pair of uprights; and lower longitudinal frame members 47, 48 extending between front and rear uprights.

Figure 4:
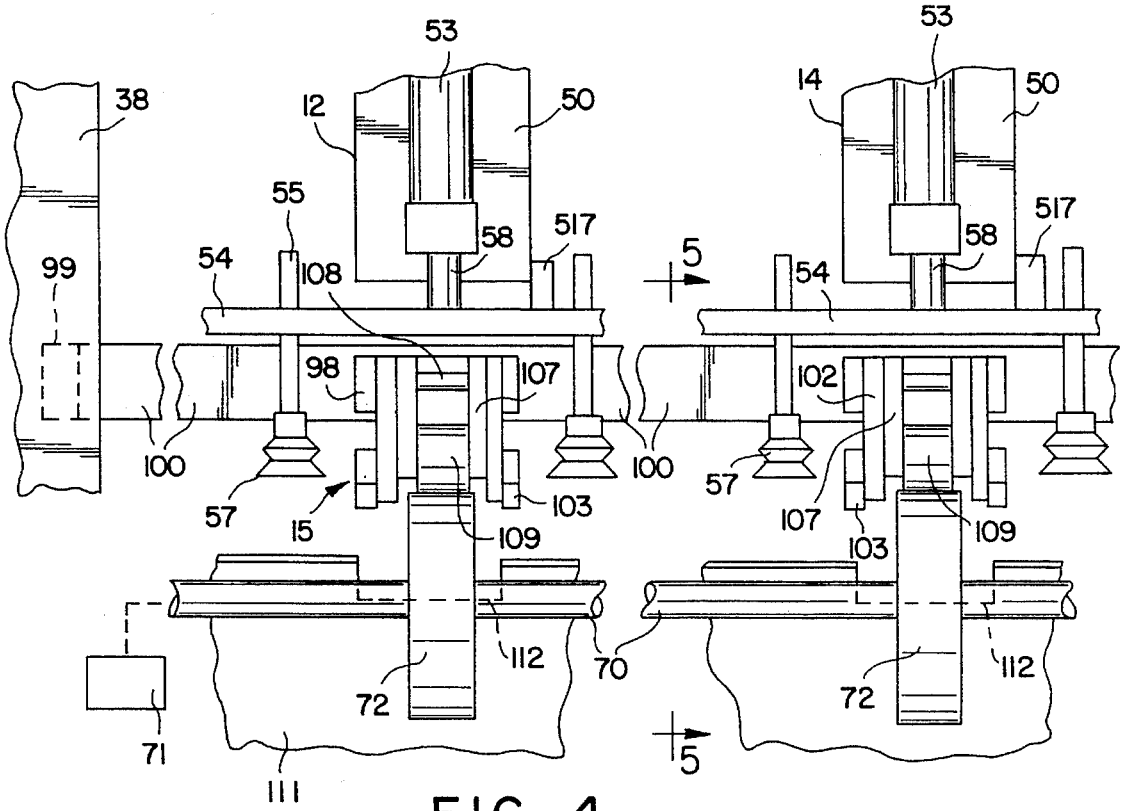
FIG. 4 is a fragmentary side view of the bag pick up and the bag feed assemblies that is generally taken along the line and in the direction of the arrows 4—4 of FIG. 2, various parts being broken away and other parts not being shown.

Referring in particular to FIGS. 2 and 4, each of the bag pick up assemblies 12, 14 includes a mounting plate 50 that is dependingly joined to a bracket 51. Each bracket is connected by a pivot 52 to a bracket which is joined to the top frame member The cylinder of a piston cylinder combination 53 is mounted by the mounting plate while its piston rod 58 mounts a longitudinal bar 54. The bar 54 mounts a pair of cup mounts 55 that in turn dependingly mount accordion type vacuum cups 57. A conventional vacuum transducer 550 is mounted to each mount 55 for applying a vacuum therethrough to the vacuum cup mounted thereto when air under pressure is applied to the transducer. A swing cylinder of a piston cylinder combination 59 is pivotally connected at 61 to a bracket 62. The bracket 62 is dependingly joined to the respective one of the transverse frame members 63 which are joined to frame members 40, 41. The piston rod of the combination 59 is pivotally connected at 60 to a lower portion of the mounting plate. The mounting plates 50 are mounted in longitudinally spaced, side by side relationship.

Even though a pair of piston cylinder combinations 59 are disclosed, advantageously an appropriate connection can be made between the mounting plates 50 whereby a single piston cylinder combination 59 can be used for swinging the mounting plates between their solid and dotted line positions of FIG. 2.

Figure 5:
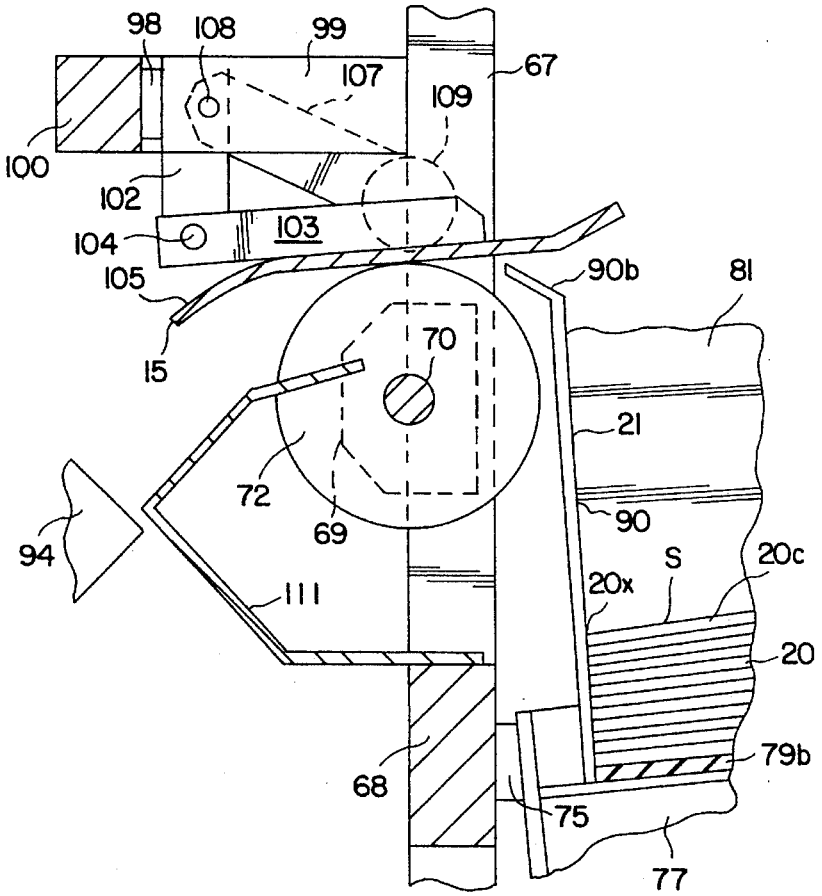
FIG. 5 is a fragmentary transverse cross sectional view of the bag feed assembly and the adjacent part of the bag magazine that is generally taken along the line and in the direction of the arrows 5—5 of FIG. 4.
Figure 6:
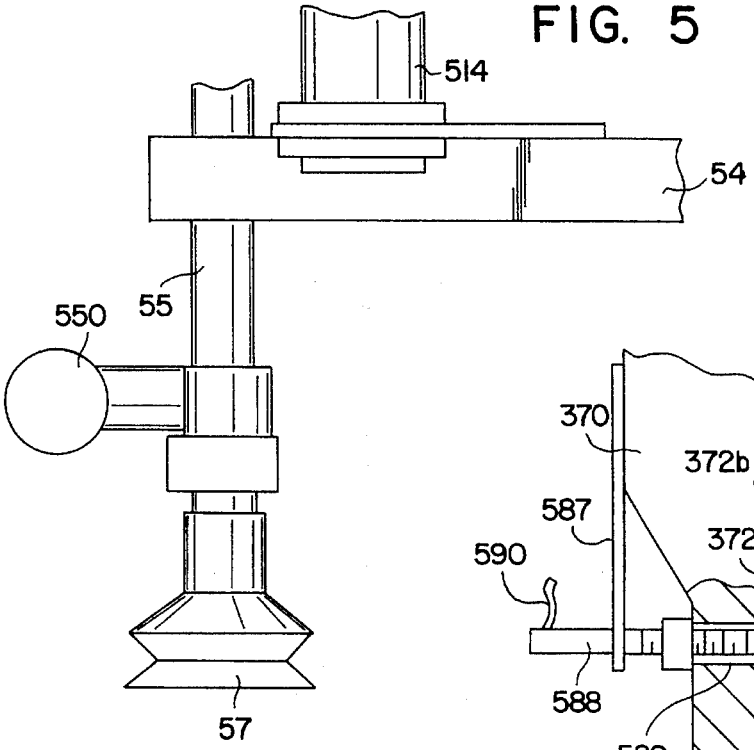
FIG. 6 is an enlarged side view of a portion of the bag pick up assembly.

The feed assembly 15 includes a pair of shaft mounts 69 that are mounted to upright 38 and a vertical frame member 67 which extends between longitudinal frame members 40, 68, frame member 68 being joined to uprights 38, 35 (see FIGS. 2, 4 and 5). A longitudinal shaft 70 is rotatably mounted by the shaft mounts and is driven by motor 71. Feed rollers 72 are keyed to the shaft 70 to be longitudinally centered relative to the pair of vacuum cups of the respective pick up assembly 12, 14.

For conveying stacks of flat folded bags to a position for being picked up by the bag positioner assemblies and fed to the feed assembly, the bag magazine includes a frame 77 that may be secured to the main frame 11 by brackets 75. The magazine frame mounts a pair of transversely aligned endless conveyors 78, 79 having their upper runs 78*b*, 79*b* driven in opposite directions 82, 83 respectively by drive motors 87, 88. A vertical, transverse stop plate 80 is mounted to the magazine frame in a fixed position for stopping the movement of the leading stack of bags R in the direction of arrow 82 to a proper position for being picked up by assembly 12, an appropriate sensor 85, for example, a photo electric eye unit controlling the actuation of motor 87 so that the next stack R is longitudinally forwardly conveyed to a position adjacent to the stop plate 80 after the last bag of the leading stack R has been picked up. A second stop plate 81 is mounted to the magazine frame for longitudinal adjustment relative to stop plate 80 by suitable mechanism (not shown) for different width bags so that bags from the respective stack are properly longitudinally spaced for subsequent operations. A conventional sensor 86, for example a photo electric eye unit, is mounted for controlling the actuation of motor 88 whereby stacks of bags S are progressively longitudinally rearwardly moved to abut against the stop plate 81 and be in proper spaced relationship to stop plate 80.

The feed assembly also includes an idler roller 109 for each feed roller 72 to form an entry nip, each idler roller being mounted by the one ends of the respective pair of arms 107. The opposite end of each pair of arms 107 is pivotally mounted by a pivot 108. Each end of pivot 108 is mounted by a depending arm 102. Each pair of arms 102 is mounted to a bar 98, the bars 98 being mounted in longitudinal spaced relationship by a longitudinal frame member 100 that is above and on the transverse opposite side of the shaft 70 from the bag magazine. The frame member 100 is mounted to the upright 28 and frame member 68 by transverse bars 99. Frame member 100 is located in transverse spaced relationship to rollers 72, 108 to permit the transverse swing movement of the cups 57 as set forth below.

The lower ends of each pair of arms 102 mounts a pivot 104 that in turn mounts the one ends of arms 103, the opposite ends mounting a baffle 105 that at one end portion extends transversely upwardly to in part overhang the longitudinally elongated plate 90 of the magazine to facilitate directing a picked up bag to the entry nip of rollers 72, 109. The plate 90, other than for the top flange **90*b*, is inclined to extend nearly vertically in a transverse direction toward shaft 70 to have the bottom edges 20*x* abut thereagainst and to extend at substantially right angles to the upper runs 78*b*, 79*b* of the endless belts of the respective magazine conveyors 78, 79**.

A suitable cutout (not shown) is provided in each baffle plate 105 to allow the roller 109 to abut against the feed roller 72 that is therebeneath. The transverse opposite end portion of each baffle 105 is downwardly directed to, in cooperation with the baffle direct a bag exiting from between the respective set of rollers 72, 109 down onto the respective set of positioner assembly members 93–95 (see FIG. 2). A baffle 111 has an upper portion provided with a cutout 112 to extend on opposite sides of the respective feed roller and is transversely inclined downwardly from a higher elevation than the shaft 70 and transversely on the side of the shaft opposite the magazine. The lower part of the baffle 111 is mounted to the frame member 68.

Figure 3:
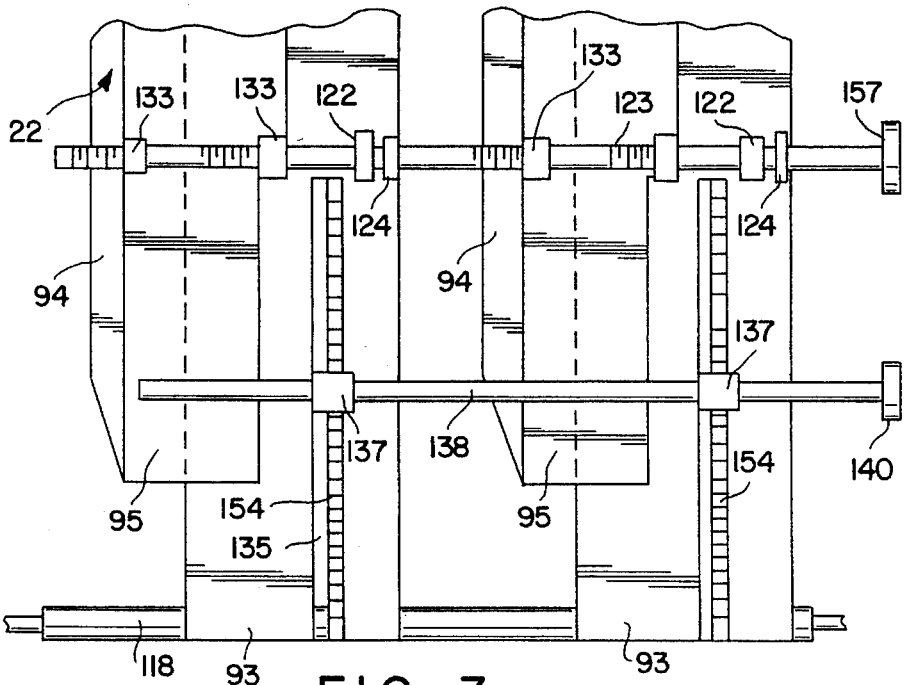
FIG. 3 is a fragmentary diagonal bottom view of the bag positioner assembly that is generally taken along the line and in the direction of the arrows 3—3 of FIG. 2.

Referring to FIGS. 2 and 3, the bag positioner assembly includes a pair of longitudinally spaced bag positioners 93–95, each positioner including an elongated plate 93 that at its lower end is joined to the one ends of mounting arms 120 which are elongated in a direction at about right angles to the plates 93. The opposite ends of arms 120 are fixed to a transverse pivot 119 that is mounted by brackets to lower longitudinal frame member 47 which is transversely opposite from the bag magazine. A lug 122 is dependingly secured to the transverse midportions of each of the plates 93 for rotatably mounting a transverse rod 123 in a fixed axial position, the one ends of links 124 being pivotally mounted by the rod 123 adjacent the respective lug. The opposite ends of the links 124 are pivotally connected at 125 to the one ends of arms 127. The opposite ends of the arms 127 are pivotally connected at 128 to the adjacent lug 129 which is joined to the frame member 68. An arm 130 at one end is secured to each arm 127 more closely adjacent to pivot 128 than pivot 125, the piston rod of a piston cylinder combination 132 being pivotally connected at 131 to the opposite end of arm 130. Brackets 134 that are welded to frame member 48 are pivotally connected at 133 to the closed ends of the cylinders of the piston cylinder combinations 132.

A pair of internally threaded lugs 122 are mounted to each positioner plate 95, the lugs 122 being mounted on the adjacent threaded part of rod 123 for transversely adjusting the position of plate 95 relative to the plate 93 that extends in overlaying relationship thereto. Each positioner also includes a plate 94 that extends diagonally downwardly toward the plate 95 to which its transverse edge is joined. A transversely elongated rack 154 is dependingly joined to each plate 93. A bag bottom stop bracket 139 extends longitudinally relative to each set of plates 93–95 and above the adjacent part of plates 93, 94. The stop brackets are transversely adjustable relative to plates 93–95 by being joined to gear blocks 137 which extend through elongated slots 135 in plates 93. The gear blocks include gears (not shown) in intermeshing relationship with the racks and mount the longitudinal shaft 138 whereby as the shaft 138 is rotated, the stop brackets are moved relative to the plates 93 in the direction of elongation thereof (double arrow). Hand wheels 157, 140 are secured to the rod 123 and shaft 138 respectively to facilitate rotating the respective member to which it is joined.

The endless conveyor assembly 17, which is located at the positioner station P, includes a longitudinally elongated flanged plate 142 that is dependingly mounted by vertical arms 140. The upper ends of the arms 140 are respectively dependingly mounted to the rear frame member 43 and the transverse frame plate 141 which in turn is mounted by frame members 40, 41. An idler sprocket 143 and a drive sprocket 144 are mounted by opposite ends of flanged plate 142 for mounting an endless chain 414. The drive sprocket 144 is driven by a shaft 145 which in turn is dependingly joined to a conventional universal joint 147. The universal joint is driven by a shaft 148 which is rotatably mounted by plate 141.

Figure 20:
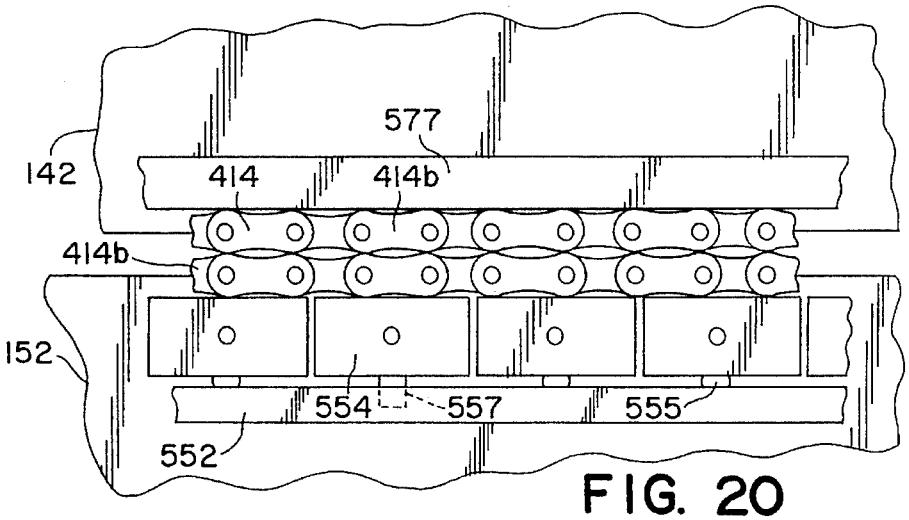
FIG. 20 is a fragmentary bottom view of the positioner station bag top edge conveyor.

The conveyor assembly 17 also includes a longitudinally elongated flanged plate 152 that is joined to the lower ends of the arms 150, the upper ends of the arms being pivotally connected at 151 to brackets 149. The brackets are mounted to the rear frame member 43 and transverse plate 141. Flanged plate 152 mounts sprockets 143, 144, which mounts an endless link chain 414, to be driven in the same manner as described relative to the sprockets mounted by flanged plate 142. The chains 414 have inner runs **414*b* that are resiliently retained in sufficiently close relationship to convey the flat folded bag top edge portion therebetween when the chains are in their chain closed position of FIG. 20. That is, the flanged plates 142, 152 dependingly mount backing strip 577, 552 respectively that extend nearly the entire longitudinal distance between the respective set of sprockets. To resiliently retain the inner runs adjacent one another, a plurality of longitudinal adjacent blocks 554 are mounted to the backing strip 552 for limited pivotal movement about vertical axes and limited transverse movement relative to the flanged plates, backing strips and chain inner runs by suitable members 553, a spring 555 abutting against each block and being extended into an aperture 557 in the strip 552**.

In order to pivot the flanged plate 152 from the chain closed solid line datum position of FIG. 2 to the chain open dotted line position for having the bag top edges moved into abutting relationship to the chain of the flanged plate 142 by the positioner assembly, the cylinder of the piston cylinder combination 160 is pivotally connected at 159 to a bracket 158 which in turn is welded to flanged plate 142. The piston rod of combination 160 is pivotally connected at 161 to a bracket 162. Bracket 162 is joined to the longitudinal midportion of a channel 163 which at its opposite ends is joined to arms 150. The pivot axes of pivots 60, 61, 119, 123, 125, 128 and 151 extend longitudinally and are parallel to one another.

Figure 8:
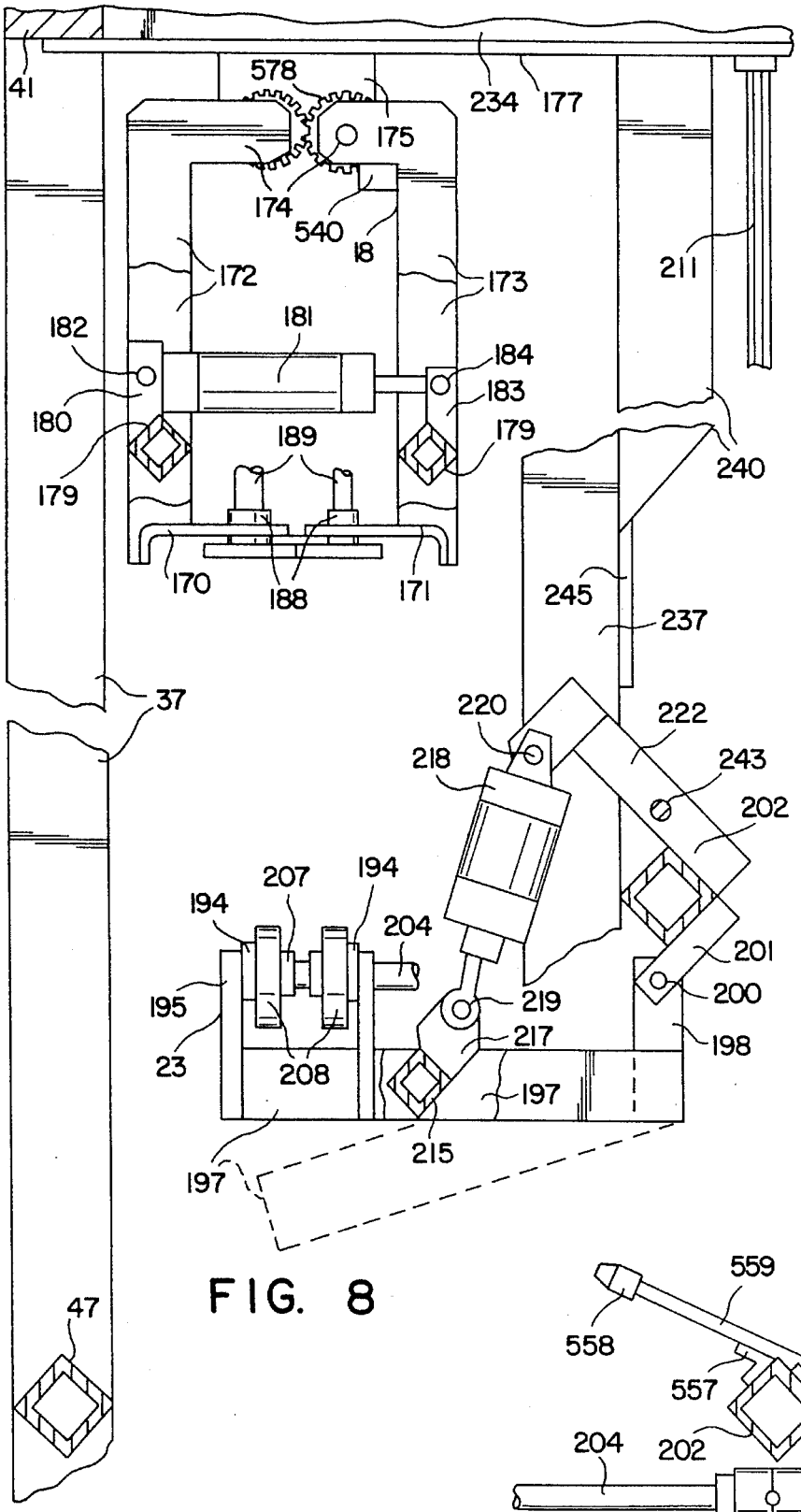
FIG. 8 is a transverse cross sectional view that is generally taken along the line and in the direction of the arrows 8—8 of FIG. 1 with various parts being broken away and other parts not being shown, said view showing the filling station bag top and bag bottom conveyors, the bag bottom conveyor being shown in its datum position in solid line and in its lowered position in dotted lines.
Figure 9:
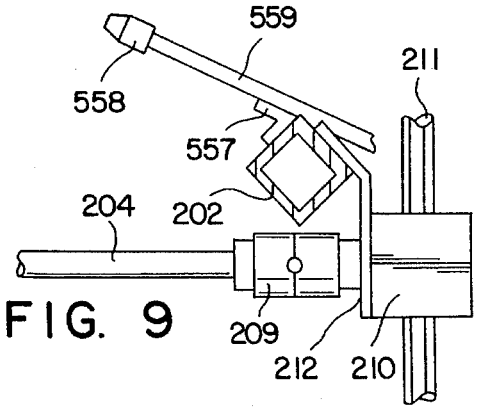
FIG. 9 is a longitudinal view of a part of the structure of FIG. 8 to show various details of the bottom conveyor drive.

Referring now to FIGS. 1, 8 and 9, the bag top conveyor assembly 18 includes oppositely faced, longitudinally elongated flanged plates 170, 171 which are respectively dependingly mounted at a somewhat lower elevation than plates 142, 152 by longitudinally spaced pairs of arms 172, 173 respectively. The upper end portions of arms 172 are fixed to pivots 174 to pivot therewith, the pivots 174 being mounted to plates 175 to pivot about coextensive pivot axes while the upper end portions of the arms 173 likewise are pivotally connected to plates 175 by pivots 174 that are transversely spaced from the pivots for arms 172. One of the plates 175 is dependingly secured to frame plate 141 while the other plate 175 is dependingly mounted to a frame plate 177 that is joined to frame members 40, 41 forwardly of frame plate 141.

Figure 14:
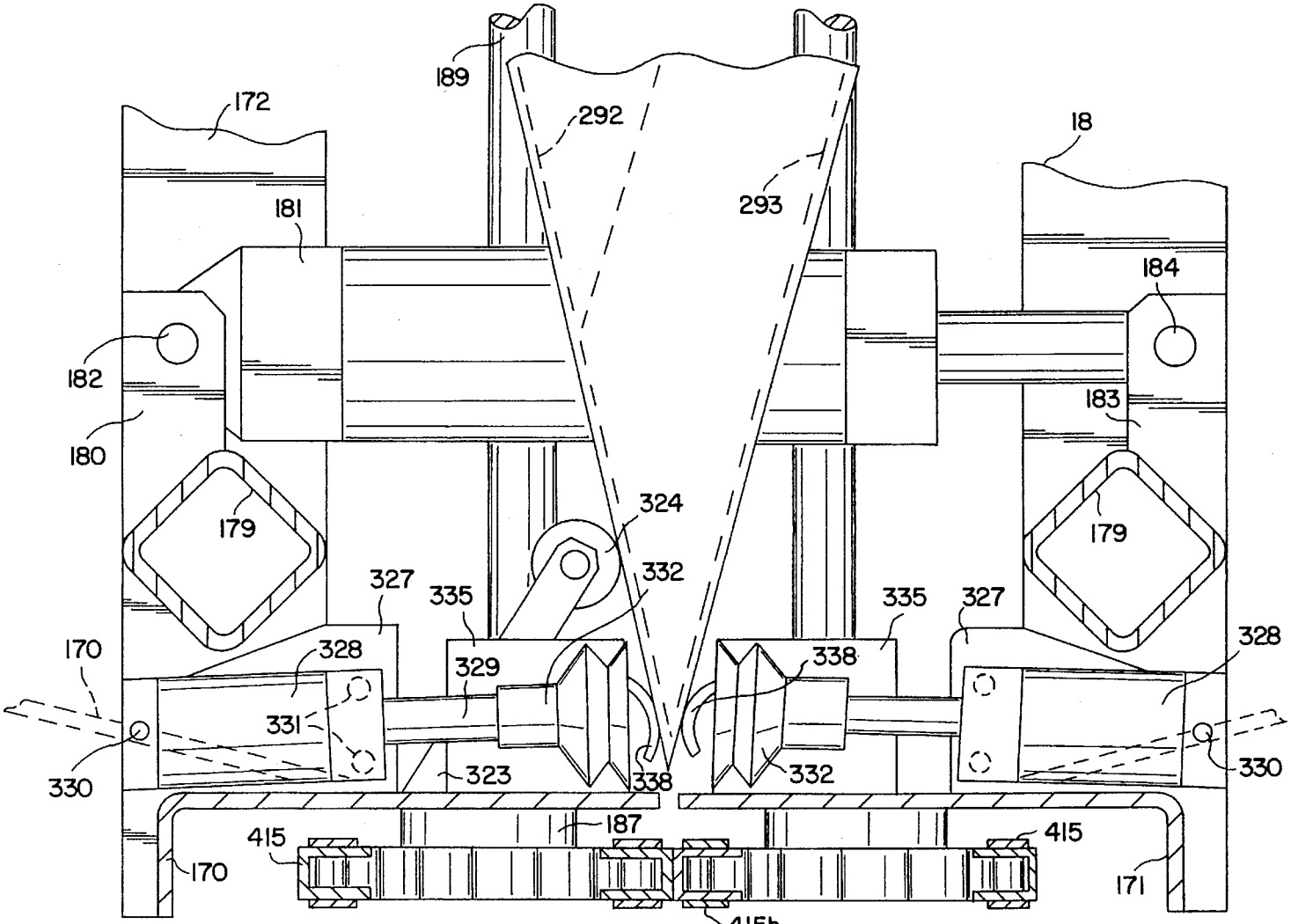
FIG. 14 is an enlarged, fragmentary transverse cross sectional view of the feeding station bag top conveyor assembly in its chain closed position and the spout jaws adjacent to their lowered position, said view being generally taken along the line and in the direction of the arrows 14—14 of FIG. 12.

In order to pivot the flanged plates 170, 171 from the closed solid line datum position of FIGS. 8 and 14 to the chain open dotted line position of FIG. 14 for having the spout jaws 292, 293 moved to their spout jaws open position, the cylinder of the piston cylinder combination 181 is pivotally connected at 182 to a bracket 180 which in turn is welded to the midportion of a longitudinal channel 179 that at its opposite ends is joined to arms 172. The piston rod of combination 181 is pivotally connected at 184 to a bracket 183. Bracket 183 is joined to the longitudinal midportion of a channel 179 which at opposite ends is joined to arms 173. In order to ensure that the arms 172, 173 are pivoted equal angular degrees in opposite angular directions, intermeshing gears 578 are keyed to pivots 174.

Each of the flanged plates 170, 171 at its rear end mounts an idler sprocket 187 and at its opposite end mounts a drive sprocket 188. The sprockets for each flanged plate mount an endless linked chain 415, each of the inner runs **415*b* of the chains 415 in the chain closed position being resiliently retained adjacent one another in the manner indicated with reference to FIG. 20. Each drive sprocket is driven by a shaft 189 that is dependingly driven by a conventional universal joint 190. Each universal joint 190 is driven by a shaft 191 that is rotatably mounted by plate 177**.

For supportingly conveying filled bags, the bag bottom conveyor assembly 23 is provided beneath the conveyor assembly 18. The conveyor assembly 23 includes longitudinally elongated frame plates 194 that are mounted to the upper ends of uprights 195, the lower ends of the uprights being mounted to the one end portions of the front and rear transverse conveyor frame members 197. The front and rear frame members 197 are located adjacent to the front and rear end portions of the conveyor assembly 23. The opposite ends of frame members 197 are mounted to the lower ends of the uprights 198, the upper ends of the uprights being connected by longitudinal pivots 200 to bars 201 which are welded to a longitudinal main frame member 202. For pivotally moving the frame of the assembly 23 between its solid line datum position of FIG. 8 and its lowered dotted line position, a channel 215 at its opposite ends is mounted to the transverse midportions of the frame members 197. The piston rod of a conveyor raise and lower piston cylinder combination 218 is pivotally connected at 219 to a bracket 217 which is welded to the midportion of channel 215, the cylinder being pivotally connected at 220 to one end of a bracket 222. The opposite end of the bracket is welded to channel 202 longitudinally intermediate bars 201.

The conveyor assembly 23 also includes rear sheaves 207 rotatably mounted to the rear end portions of the frame members 195 while the front end portions of these frame members rotatably mount one end portion of a drive shaft 204. Drive sheaves 207 are keyed to shaft 204 for driving the endless belts 208 which extend around the rear sheaves. The opposite end of the shaft 204 mounts a universal joint 209 which in turn is drivenly connected to the output shaft of an angle gear device 210. The device is mounted by a bracket 212 to channel 202 such that the shaft 204 can pivot about a longitudinal axis that is substantially coextensive with the pivot axes of the pivots 200. The device 210 is vertically slideably, drivenly mounted on the vertical drive shaft 211 which, other than for its upper end portion, in horizontal cross section may be, for example, hexagonal.

Figure 22:
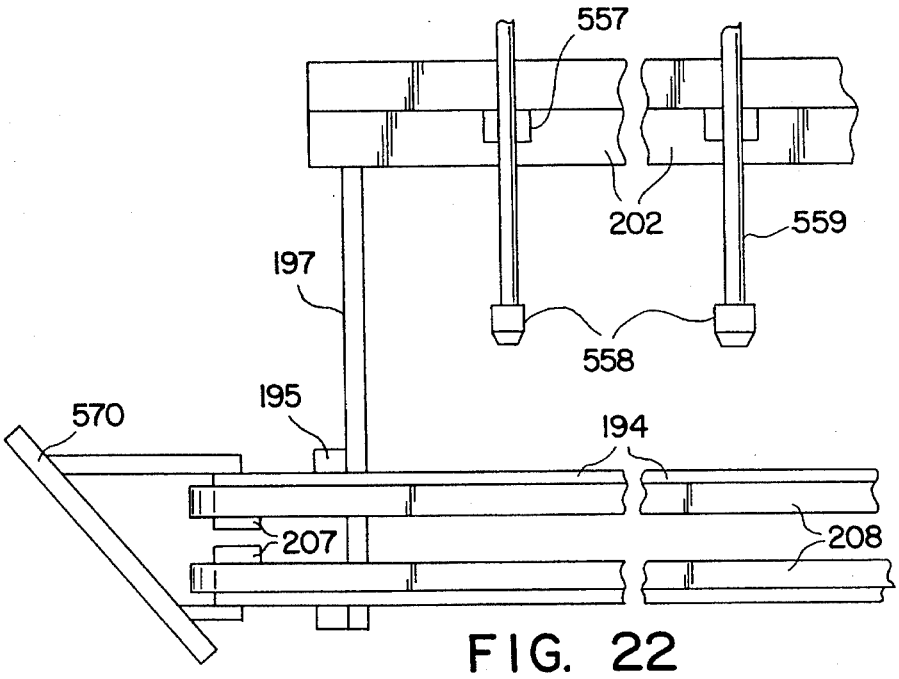
FIG. 22 is a fragmentary top view of the rear end portion of the bag filling station bag bottom conveyor and air jets.

To deflect the bottoms of empty bags being conveyed by conveyor assemblies 17, 18 transversely to the side of conveyor assembly 23 when the bag bottom conveyor assembly is in its datum position, a forwardly and transversely inclined deflector 570 is secured to the rear portions of plates 194 to be located rearwardly thereof and at a lower elevation than the top runs of the conveyor belts (see FIG. 22). In the conveyor assembly lowered position, the deflector is at an elevation to be out of the path of movement of empty bags.

The bag top conveyor assembly 19, which is at the transfer station T, includes oppositely faced, longitudinally elongated flanged plates 250, 251 which are respectively dependingly mounted at about the same elevation as plates 170, 171 by longitudinally spaced pairs of arms 249, 252. The upper end portions of arms 249 are pivotally connected by pivots 253 to plates 254 to pivot about coextensive pivot axes while the upper end portions of the arms 252 are mounted in fixed relationship to plates 254. One of the plates 254 is dependingly secured to frame plate 177 while the other plate 254 is dependingly mounted to a frame plate 255 that is joined to frame members 40, 41 forwardly of frame plate 177.

Figure 23:
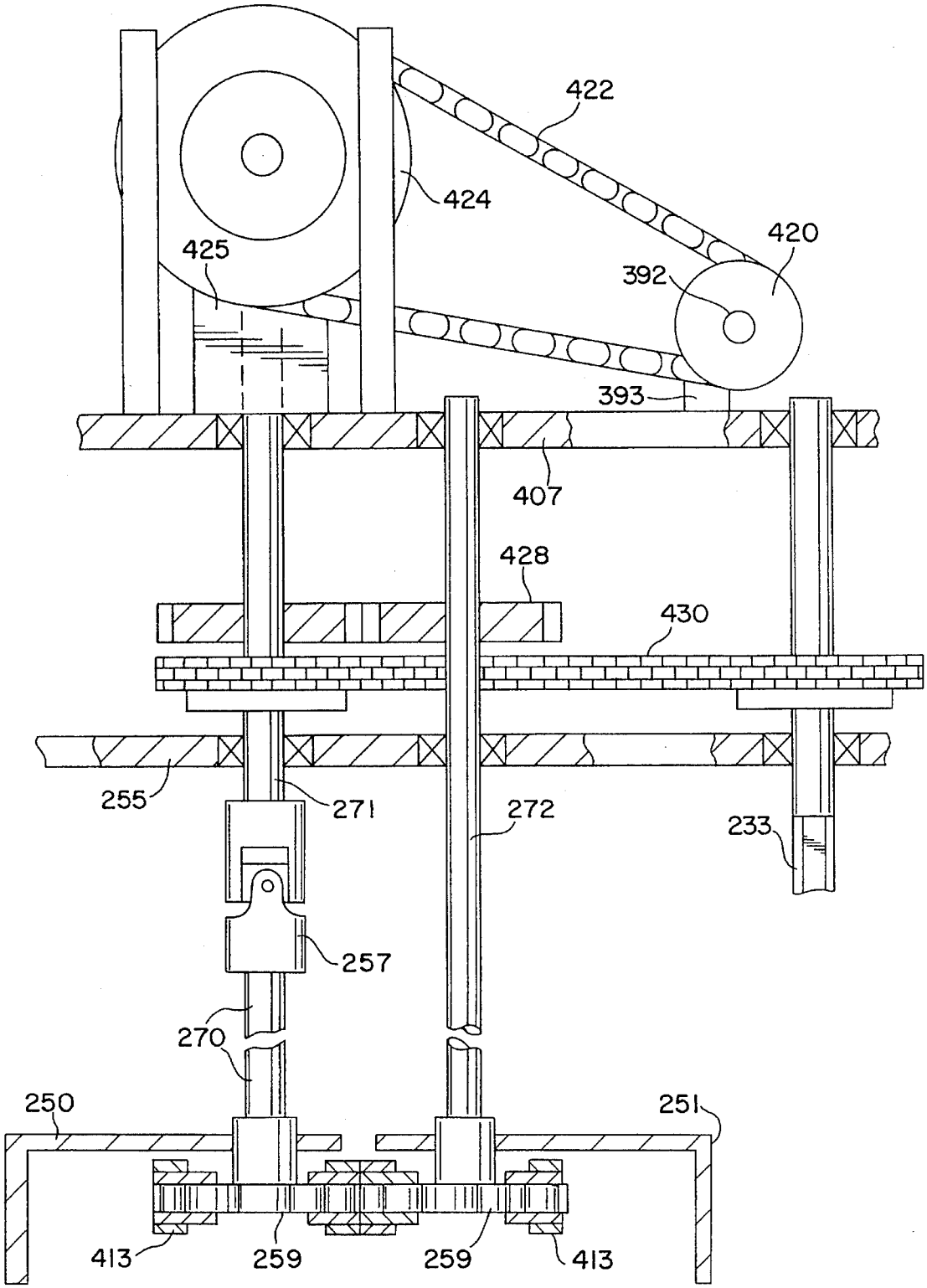
FIG. 23 is a fragmentary front end view of the bag top edge portion conveyor assembly and some of the drive structure, mostly in transverse cross sectional view.

Each of the flanged plates 250, 251 at its rear end mounts an idler sprocket 258 and at its opposite end mounts a drive sprocket 259. Each set of sprockets 258, 259 mounts an endless chain 413 (see FIG. 23) to, in the chain closed position, be resiliently retained adjacent to one another in the manner described with reference to FIG. 20. The drive sprockets are driven by shafts 270, 271, shaft 270 being dependingly driven by a conventional universal joint 257. The universal joint 257 is driven by a shaft 271 that is rotatably mounted by plate 255. The universal joint 257 is pivotal about an axis substantially coextensive with the pivot axes of pivots 253 whereby the flanged plate 250 can pivot from its datum solid line position to its dotted line position, a spring (not shown) advantageously being connected between one set of arms 249, 252 to resiliently retain the flanged plates in their solid line, chain closed position.

Figure 11:
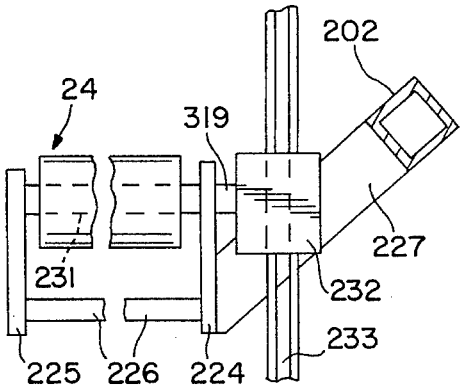
FIG. 11 is a view of a part of the structure of FIG. 10 to show various details of the bag bottom conveyor mounting and drive.
Figure 12:
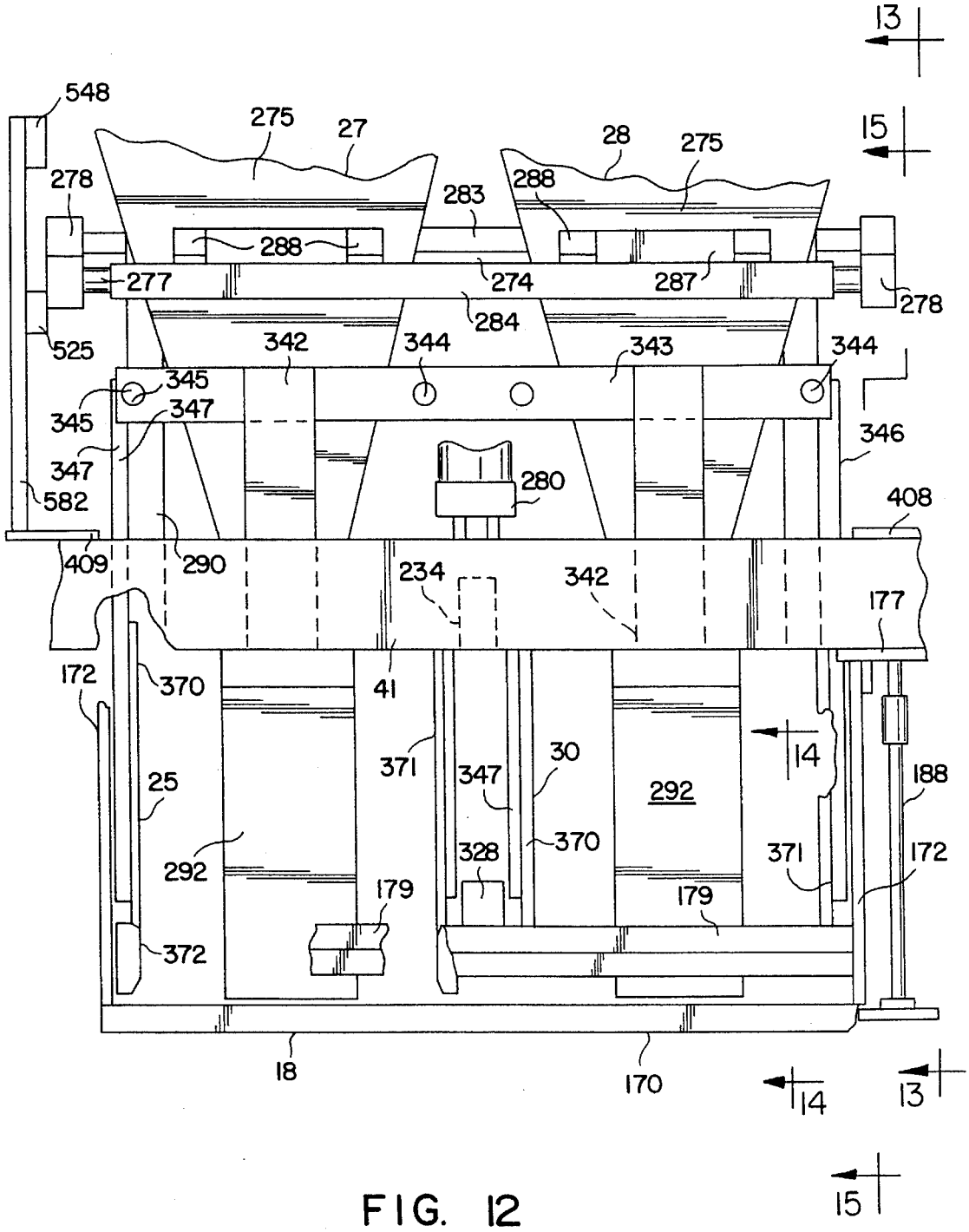
FIG. 12 is a fragmentary side view of the bag top filling conveyor assembly, the bag hanger assemblies and the hopper spout assemblies with various parts being broken away and other parts not shown, the hopper spout assemblies being shown in their lowered discharge positions.

Referring to FIGS. 1, 10 and 11, the bag transfer bag bottom conveyor assembly 24 includes a conveyor frame that in part is made up of a longitudinal frame member 225 joined to the lower end of corresponding frame member 224 by transverse bars 226. The lower end of frame member 224 is mounted to one end of the respective one of front and rear transverse arms 227, the opposite ends of which are mounted to channel 202. A rear idler roller 230 is rotatably mounted by the rear portion of frame members 224, 225 while a front roller 230 is keyed to drive shaft 219 which is rotatably mounted by frame members 224, 225 and is driven by the output of the conventional angle gear device 232. The device 232 is vertically movable relative to the vertical drive shaft 233, which may be, other than for its upper end portion, hexagonal in cross section, while remaining in driven relationship thereto. An endless belt 231 is extended around rollers 230 to have its upper run **231*b* at substantially the same elevation as the upper runs 208*b* of the endless belts 208 of the conveyor assembly 23** when the conveyor assembly is in its datum position.

Top transverse frame members 234, 235 at their opposite ends are mounted to frame members 40, 41 in longitudinal spaced relationship. Each of the frame members 234, 235 has a vertical frame member 240 dependingly secured thereto while the lower end portion of each of members 240 is joined to the adjacent longitudinal edge of the upper portion of vertical frame member 237. To the lower end portion of each of members 237 there is joined one end of a transverse channel 239, the opposite ends being joined to channel 48.

The front end of the channel 202, which is adjacent to the front frame member 237, is mounted to a front transverse plate 238. Plate 238 rotatably mounts the front end portion of a longitudinal shaft 243 that is driven by a motor 242 which also may be mounted by plate 238. A vertical toothed (teeth not shown) rack 245 is mounted to each frame member 237 to have the teeth of the respective gear 244 intermesh therewith. An idler roller 245 bears against the edge of the respective frame member 237 opposite rack 245 at an elevation that advantageously is between gear 244 and the rotary axis of shaft 219. Gears 244 are keyed to shaft 243, the rear end portion of shaft 243 and the rear roller 245 being rotatably mounted by an arm (not shown) welded to channel 202 at a location for the rear roller to abut against the rear frame member 237. Upon actuating motor 242 by suitable controls (not shown), the elevation of the channel 202 and thereby the conveyors 23, 24 are selectively vertically adjusted for bags of various length (height) dimensions.

Instead of using motor 242, a hand crank (not shown) may be used to selectively vertically adjust the elevation of the conveyors 23, 24. Further, instead of using racks 245, linked chains (not shown) at their opposite ends can be fixed to frame members 237 with the links along their vertical lengths being in abutting relationship to the adjacent edge of the frame member. If lengths of linked chains are used, than sprockets (not shown) would be used instead of gears 244. An advantage of using linked chains instead of racks, is that there is a decreased likelihood of material collecting so as to not interfere with adjusting the elevation such as might occur when using racks and gears.

Figure 15:
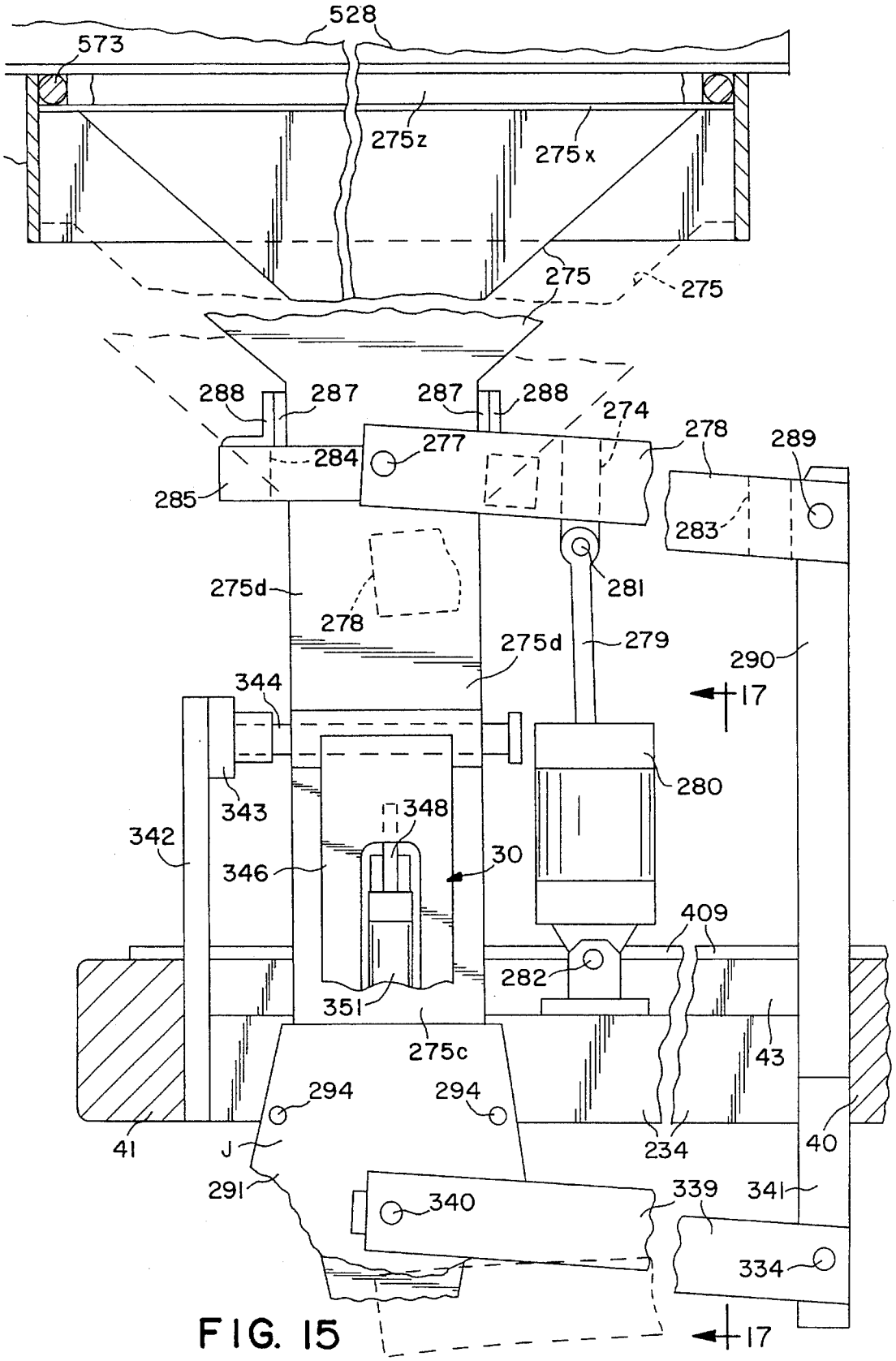
FIG. 15 is a fragmentary transverse cross sectional view showing a hopper spout assembly in its datum position in solid lines and in its lowered product discharge position in dotted lines and showing a portion of a scale one of the bag hanger assemblies, said view being generally taken along the line and in the direction of the arrows 15—15 of FIG. 12 with longitudinal and transverse intermediate parts being broken away.

Referring to FIGS. 12-15, each hopper spout assembly 27, 28 includes a spout 275 that is vertically movable between the solid line datum position of FIG. 15 and the lowered dotted line product discharge position. For mounting and vertically moving the hopper spout assemblies, longitudinal bars 284 and transverse bars 285 are joined together to form an open rectangular frame for having the vertical midportions 275*d* of the hopper spouts extended therethrough. Each of the longitudinal bars mount angle brackets 288 which mount mounting strips 287 that are fixed to the spout midportions 275*d*. The midportions of the transverse bars 285 are mounted by longitudinal pivots 277 to the one ends of transverse bars 278, the opposite end of the bars being pivotally connected at 289 to the upper ends of uprights 290. The lower ends of the uprights are mounted to the frame member 40. A longitudinal brace 283 has its opposite ends welded to bars 278 adjacent to pivots 289.

Bars 341 which are dependingly secured to frame member 40 have their lower ends pivotally connected at 334 to the one ends of the transverse arms 339. The opposite ends of the arms are pivotally secured by pivot members 340 to the adjacent jaw mounting plate 291 of the respective jaw subassembly J which is described below. The spacing of pivots 277, 289, 334, 340 are such to form a parallel linkage system for controlling the pivotal vertical movement of the hopper spout assemblies.

The opposite ends of a longitudinal brace 274 are welded to the midportions of the bars 278, the brace 274 being pivotally connected at 281 to the piston rod 279 of the piston cylinder combination 279, 280. The cylinder 280 is pivotally mounted to the transverse frame member 234 at 282.

Figure 13:
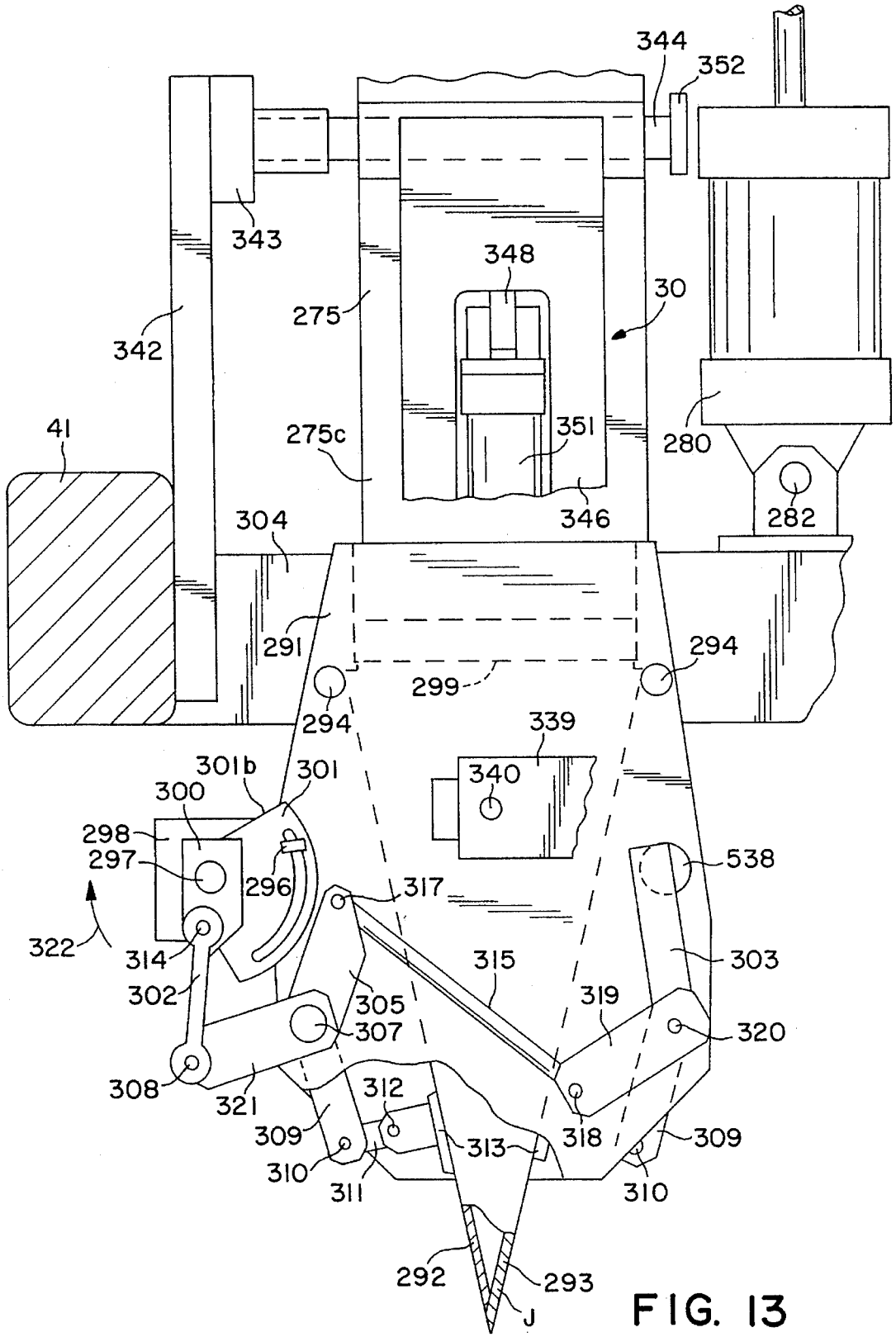
FIG. 13 is a fragmentary transverse cross sectional view showing one of the spout jaw subassemblies, said view being generally taken along the line and in the direction of the arrows 13—13 of FIG. 12 other for the jaw subassembly being shown in its datum position.

For controlling the discharge of product from each hopper spout assembly, there is provided a spout jaw subassembly J (see FIG. 13). Each jaw assembly J includes a mounting band 299 that is mounted to the lower end portion 275*c* of the respective spout 275 and in turn dependingly mounts a jaw mounting plate 291 on each longitudinal side of the spout. The mounting plates 291 pivotally mount a pivot rod 294 on each transverse side of the spout portion 275*c*, one of the rods pivotally mounting a spout jaw 292 and the other pivotally mounts a jaw 293 to, in a jaw closed position, cooperates with jaw 292 to block discharge of product from the respective hopper spout assembly.

For moving the jaws of each subassembly J between their product discharge and closed positions, an air pressure operated rotatory actuator 298 is mounted to the plates 291, the application of pressurized air resulting in the rotation of the actuator rod 297 about a longitudinal axes. The actuator rod 297 has a block 300 keyed thereto, the block mounting a pivot 314.

Each jaw subassembly includes an arm pivot 307 rotatably mounted by the mounting plates 291 and is fixed to the midportion of a control arm 305. One end of a link 309 is fixed to pivot rod 307 to pivot therewith while the opposite end is connected to one end of link 311 by pivot 310. The opposite end of link 311 is pivotally connected at 312 to a bracket 313 that is attached to the longitudinal midportion of jaw 292. For pivoting the rod 307, one end of arm 321 is Keyed thereto while the opposite end is pivotally connected at 308 to link 302 while the opposite end of link 302 is pivotally connected at 314 to an end portion of block 300. The opposite end of arm 305 is pivotally connected at 317 to a connector rod 315. The opposite end of rod 315 is pivotally connected at 318 to one end of an arm 319 while a remote portion of the arm 319 is mounted in fixed relationship to pivot rod 320. Pivot rod 320 is pivotally mounted by plates 291 while one end of a second link 309 is fixed to rod 320 to pivot therewith. The second link is pivotally connected through second pivots 310 and 312 (not shown) and bracket 313 to jaw 293 in the same manner described with reference to jaw 292. In view of pivot axes of pivot rods 317, 318 being located on opposite sides of the plane of the pivot axes of pivots 307, 320 when the jaws are closed, as piston rod 297 is rotated in one angular direction, the spout jaws pivot in opposite angular directions relative to the pivot axes of the respective pivot rod 294 toward their open positions.

In order to permit adjusting the degree of opening of the jaws of each jaw subassembly, an arcuate plate 301 is mounted on the actuator rod 297 for pivotal movement relative thereto. A clamp member 296 is extended through an arcuate slot in plate 301 and mounted to the housing of the actuator 298 to clamp the arcuate plate in selected angular positions relative to the rod 297. The pivoting of pivot 314 in the direction of arrow 322 from its jaw closed position of FIG. 13 to its jaw open position is limited by abutting against the generally radially extending edge 301*b* of plate 301.

Figure 16:
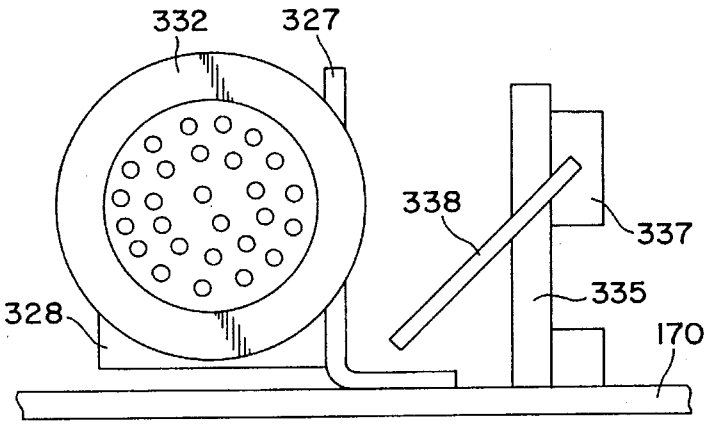
FIG. 16 is a fragmentary longitudinal view showing one of the bag top opening vacuum cups and the adjacent no bag no product sensor device.

In order to retain the jaws in their closed position until the flanged plates 170, 171 are transversely pivoted toward their open position, a diagonal brace 323 is welded to flange plate 170 for mounting a roller 324 to abut against the longitudinally extending wall of jaw 292 (see FIG. 14). In order to transversely spread bag top edge portions that extend above the flanged plates 170, 171, there is provided a bag top edge portion opening mechanism that includes for each filling station flanged plate, an upwardly extending bracket 327 that is mounted to the respective plate (see FIGS. 14, 16). A pivot 330 connects the closed end of a cylinder 328 of a piston cylinder combination 329, 328 to bracket 327 while the opposite end of the cylinder is secured to the bracket for being retained in an adjusted angular position by cap screws 331 which extend through an arcuate slot (not shown) in the bracket and are threaded into the cylinder. Each piston rod 329 mounts a vacuum cup 332 for movement toward the other vacuum cup 332 whereby as the piston rods are extended, the cups grippingly engage the longitudinal central bag top edge portion of the adjacent bag side wall.

In order to ascertain whether or not a bag is in position below the respective spout jaw subassembly for being filled, for each of the subassemblies, a bracket 335 is mounted to each flanged plate 170, 171. A no bag no product sensor 337 is mounted to each bracket 335. Each sensor includes an operating member 338 in the form of a curved, resilient cable or wire, or a coiled spring having an electrically conductive portion abuttable against the adjacent metal spout jaw. The operator members for each spout jaw subassembly are located to have folded bag top edge portions pass therebetween and in the event one bag side wall, bag top edge portion is not located between the operator member and the adjacent jaw when the jaw subassembly is in its lowered position, a circuit is completed such that the adjacent spout jaw assembly will not open.

Referring in particular to FIGS. 12, 15, 18 and 19, the bag hanger assemblies 25, 30 include uprights 342 joined to the frame member 41 which at their upper ends mount a longitudinal bar 343. For each hanger assembly, the bar 343 mounts a transverse rear pivot 345 and a transverse front pivot rod 344 to extend rearwardly and forwardly respectively of the adjacent hopper spout assembly 28. On the transverse opposite side of the spouts from the bar 343, end portions of the pivot rods are pivotally mounted by bar 352.

Each of the pivot rods 344, 345 dependingly mounts a vertically elongated hanger plate 346, 347 respectively, each hanger plate mounting a bracket 348 to which the upper end of a hanger cylinder 351 of the piston cylinder combination 350, 351 is dependingly, pivotally attached with the cylinder in part extending within a cutout in the plate. Each of the hanger plates mounts a pair of transversely spaced, longitudinal pivots 357, 358 that pivotally mount the upper end portions of the clamp fingers 370, 371 respectively on transverse opposite sides of the piston rod 350 to extend a substantial distance below the respective plate. Each set of clamp fingers 370, 371 at their lower end portions mounts clamp pads 372 that advantageously have resilient pad portions in abutting relationship when the piston rod 350 is in its retracted position.

Guide strips 379 are mounted to the transverse opposite sides of the lower portions of each hanger plate to extend downwardly to an elevation intermediate the lower ends of the clamp fingers and the hanger plate. A cam block 373 is mounted to the lower end of each piston rod 350, to in the piston rod retracted position, be below the lower end of the respective plate 346. Each cam block has a vertical groove 380 on each transverse side for having the adjacent strip 379 extended thereinto in both the extended and retracted positions of the piston rod 350. The cam block also has transverse spaced cam slots 374, 375 that are arcuately curved to diverge in an upward direction. Each set of clamp fingers 370, 371 mounts a cam follower 377, 378 to extend in cam following relationship to the respective slot 374, 375. Each set of plates 346, 347 mount its clamp fingers 370, 371 to longitudinally face one another.

While the piston rods 350 for the respective hopper spout assembly are being extended, the cam blocks are moved downwardly and the cam followers force the clamp fingers to pivot about their respective pivots in opposite angular directions to move the respective set of pads 372 apart from one another sufficiently to have the bag top edges moved therebetween. After the bags have moved in proper vertical alignment with the respective hopper spout assembly, the piston rods are retracted which results in the pads clampingly engaging the respective bag adjacent its upper corner portions.

Figure 17:
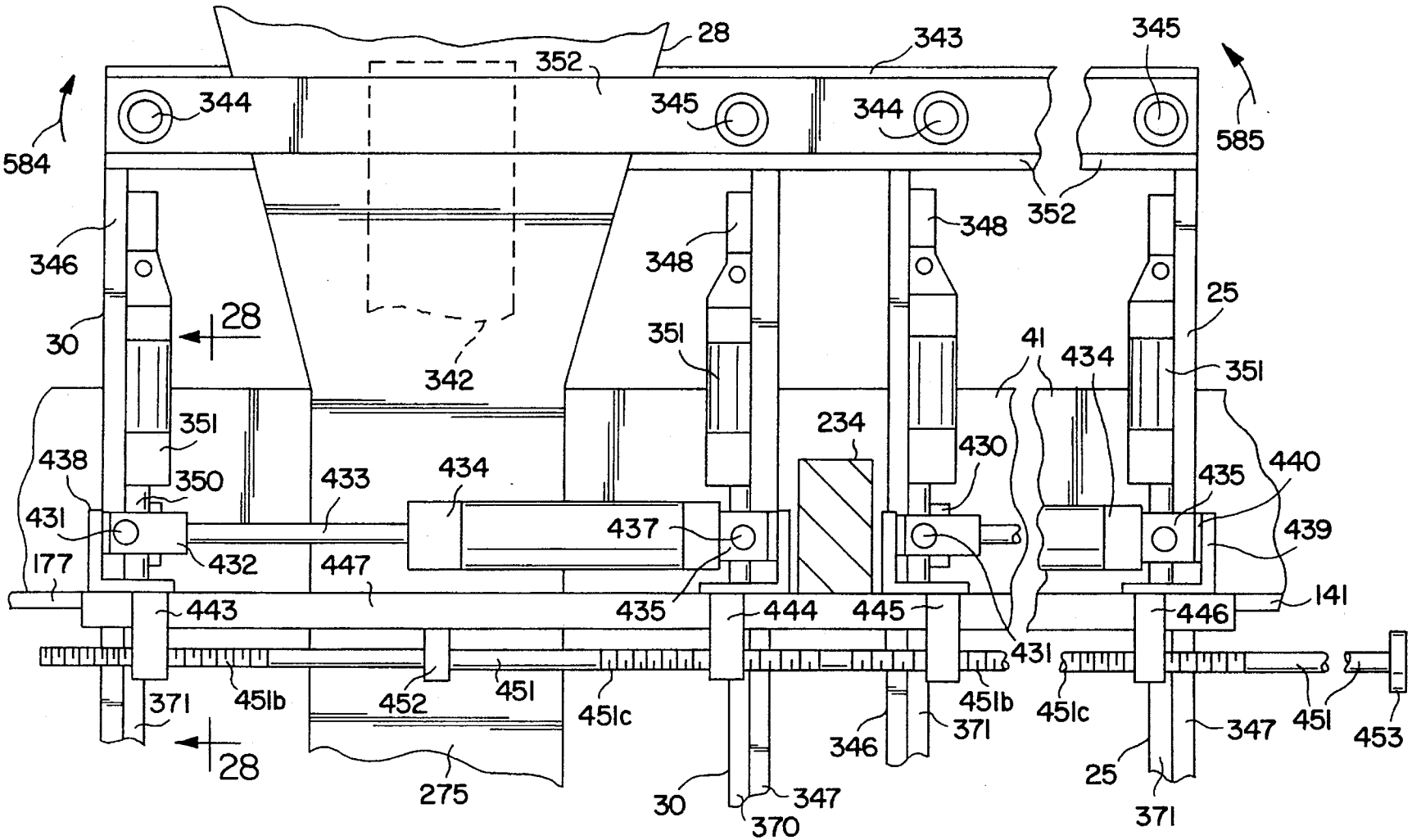
FIG. 17 is a fragmentary side view showing the mounting of the bag hanger assemblies and mechanism for adjusting the maximum longitudinal spreading of the clamp pads for each of the bag hanger assemblies; said view being generally taken along the line and in the direction of the arrows 17—17 of FIG. 15 with various parts not being shown and longitudinal intermediate parts being broken away
Figure 18:
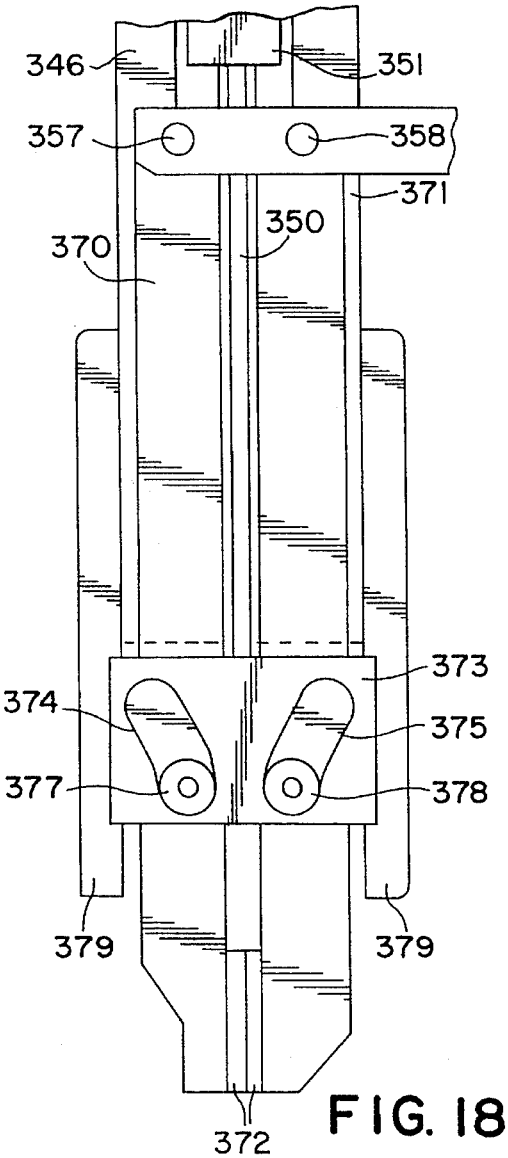
FIG. 18 is a transverse view of the lower portion of one of the bag top edge clamps in its clamped position, said view being generally taken along the line and in the direction of the arrows 18—18 of FIG. 19.
Figure 19:
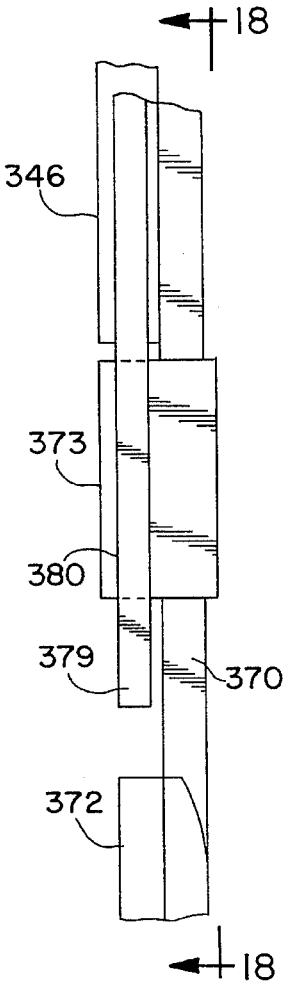
FIG. 19 is a side view of the structure of FIG. 18.
Figure 28:
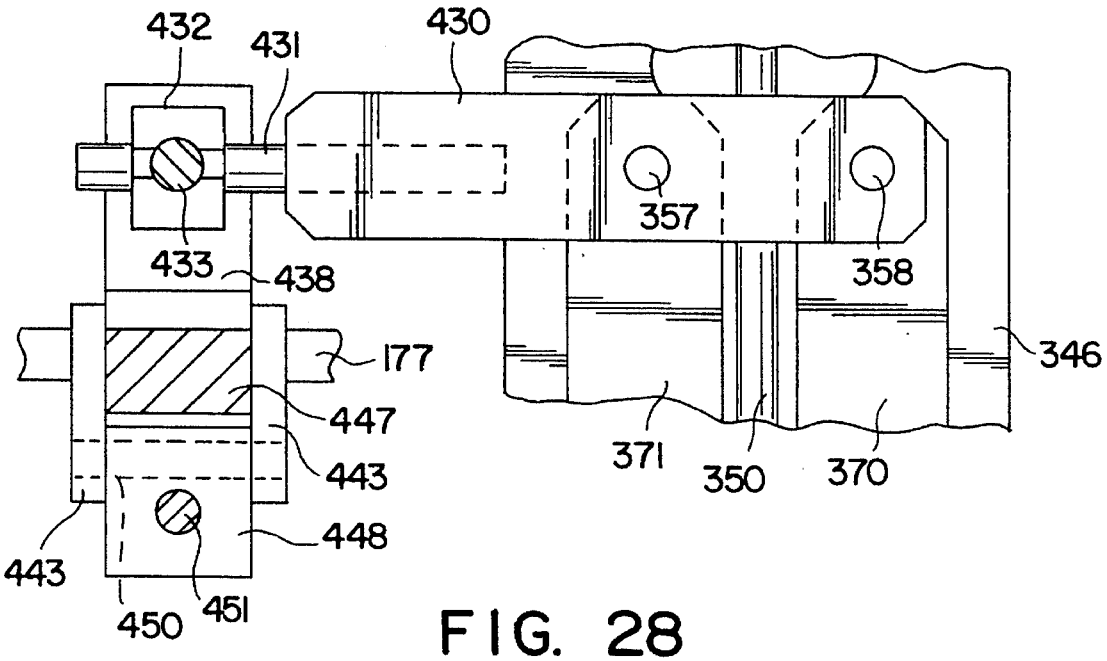
FIG. 28 is a fragmentary view of a portion of the mechanism for controlling the pivotal movement of the bag hanger assemblies relative to a spout.

Even though other structure may be used for simultaneously or individually controlling the movement of the hanger plate assemblies between their solid line datum positions of FIGS. 17, 28 and their dotted line bag top open positions, advantageously for each of the hanger assemblies, a transverse plate 430 is mounted by pivots 357, 358 of each of the mounting plates 346, 347. The plate 430 that is adjacent to plate 346 mounts a transverse pivot 431 while the pivot 437 which is adjacent to plate 347 mounts a transverse pivot 437. Each pivot 437 pivotally mounts a clevis block 435. The block 435 in turn mounts the closed end of a bag mouth closer cylinder 434, the piston rod 434 mounting a clevis block 432. The clevis block 432 is pivotally mounted by the pivot 431.

For limiting the maximum longitudinal spacing of the pivots 431, 437 for each hanger assembly, the remote vertical transverse surfaces of the blocks 432, 435 are abuttable against resilient pads 440 that are mounted by the vertical legs of oppositely facing angle irons 438, 439 respectively. The horizontal legs of the angle irons are slideable along a longitudinal track 447 that is generally rectangular in longitudinal cross section and at its opposite ends mounted to plates 141, 177 respectively. The horizontal legs of the angle irons 438,439 of the hanger assembly 30 each dependingly mounts a pair of lugs 443, 444 respectively to extend along opposite sides of the track, while the angle irons of assembly 25 likewise dependingly mount a pair of lugs 445, 446 respectively. The lower end portions of each of the pair of lugs mounts a transverse pivot 450, each pivot mounting the upper end portion of a nut 448. The nuts 448 mounted by lugs 443, 445 have internal threads that form a mating threading fit with the threaded portions **451*b* of the longitudinally threaded rod 451 while the lugs 444, 446 have internal threads that form a mating threading fit with the threaded portions 451*c* of the longitudinal threaded rod 451. Portions 451*b* and 451*c* are oppositely threaded. A hand wheel or crank 453 is keyed to one end portion of rod 451 to rotate the rod. Rotating the rod in one angular direction results in the lugs 443 and 444 being moved longitudinally more closely adjacent to one another as are lugs 445 and 446 to limit the maximum longitudinal spreading of the clamp pads of each of the hanger assemblies for narrower width bags. That is, the resilient bumpers 440 in abutting against the angle irons 438, 439 limit the pivotal movement of the mounting plates 346, 347 about their pivots 344, 345 respectively in the angular direction of arrows 584, 585. To make the adjustment for wider mouth bags, the rod is rotated in the opposite angular direction whereby the lugs 443 and 444 are moved further apart from one another as are lugs 445 and 446. The rod 451 is mounted for rotation in a fixed longitudinal position relative to the hopper spout assemblies by longitudinally spaced blocks 452 which are dependingly fixed to the track 447**.

Figure 27:
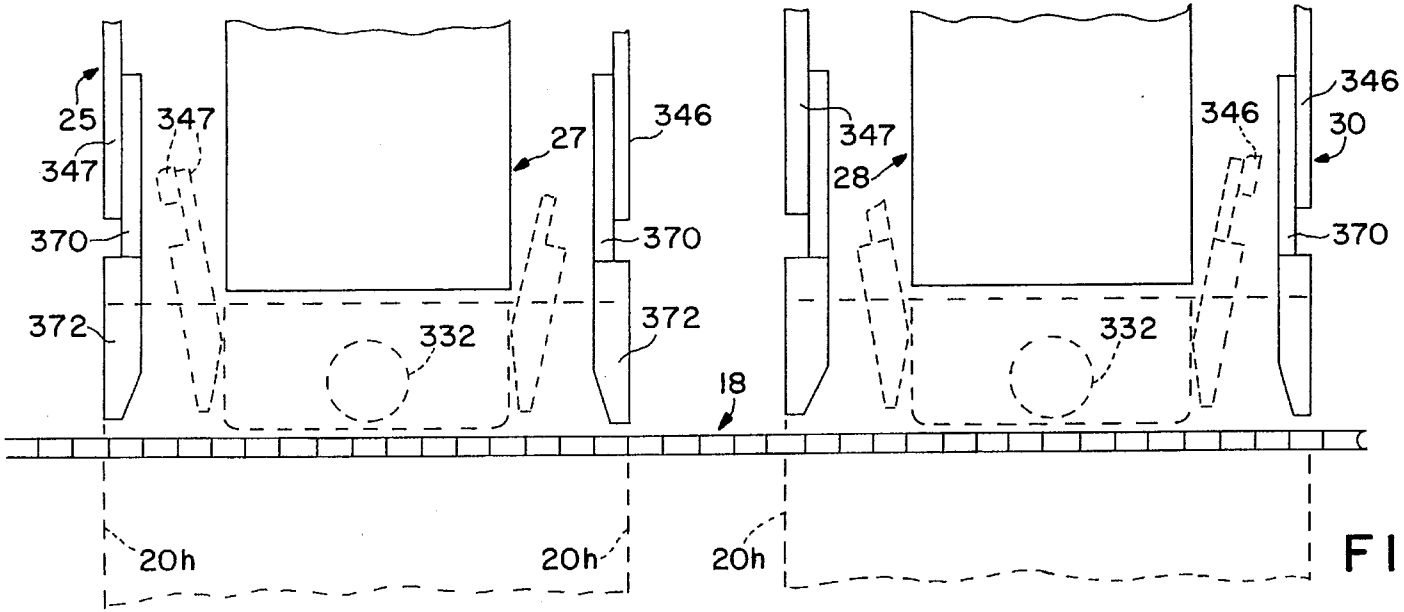
FIG. 27 is a diagrammatic showing of the clamping fingers in their bag top datum position in solid lines and in their bag mouth open position in dotted lines.

When the piston rods 433 are operated to their extended positions, the plates 346, 347 are pivoted in opposite angular directions about pivots 344, 345, the extension of the piston rods being limited by the angle irons 438, 439. Additionally, the vacuum cup 332 of each of the hopper spout assemblies is substantially longitudinally centered relative to the clamp pads of the arms 346, 347 of the respective hanger assembly in each of their datum solid line and their dotted line bag mouth open positions of FIG. 27 positions. The subassembly plates 291 are mounted so as not to interfere with the movement of the hanger assemblies between their positions.

Figure 21:
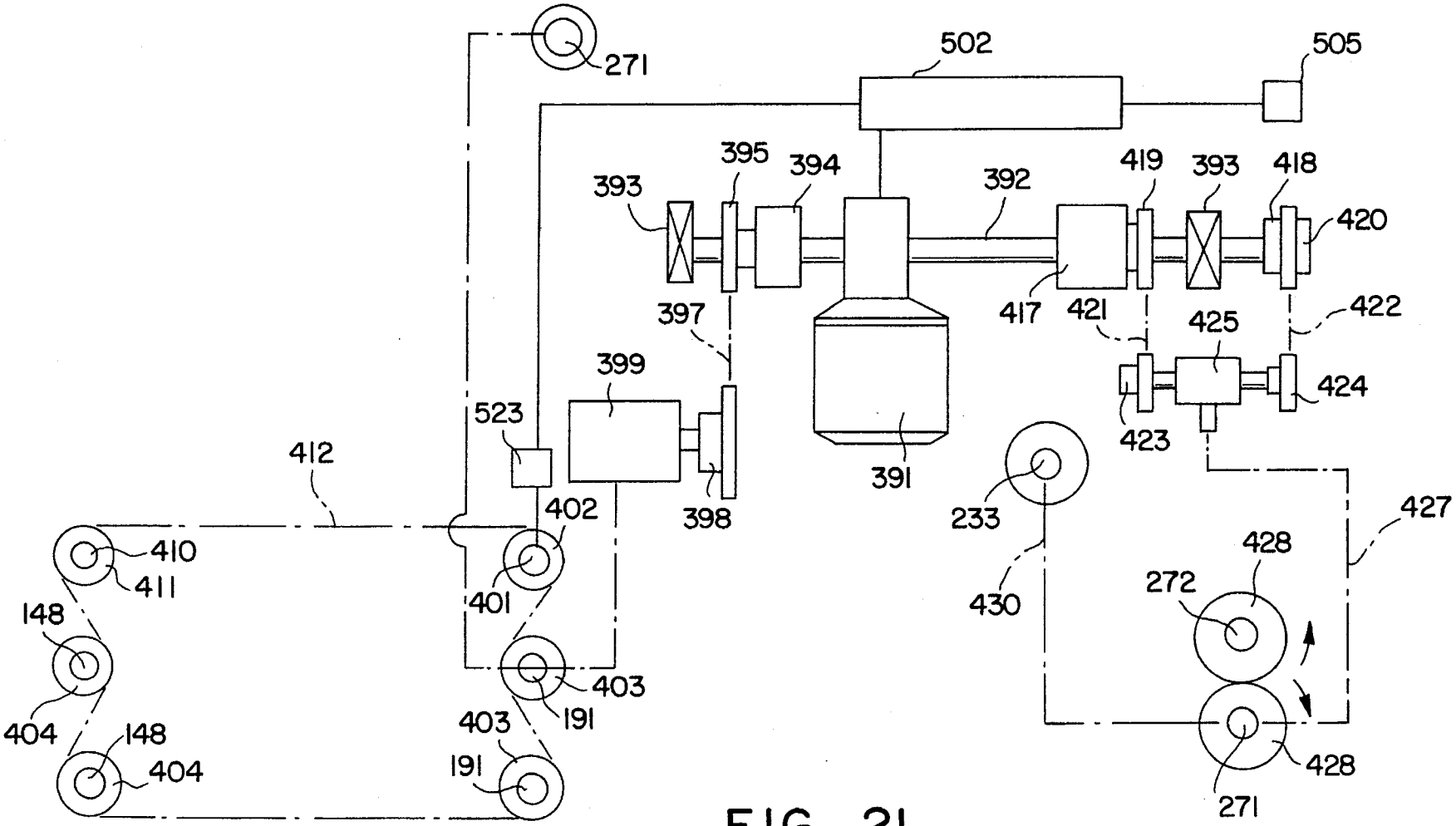
FIG. 21 is a somewhat diagrammatic showing of the components for driving the conveyor assemblies.

For driving the bag top edge and bag bottom endless conveyors, a motor reducer combination 391 is mounted by a bracket (not shown) to frame member 41. The motor reducer drives a shaft 392 which is journalled for rotation by members 393 mounted to plates 407, 408, (see FIGS. 1, 10 and 21). Plates 407, 408 are secured to frame members 40, 41. A sprocket 395 driven by an air operated clutch 394 is drivingly connected to sprocket 398 by a drive chain 397, clutch 395 applying a driving force from the shaft 392 when air under pressure is applied to the clutch. The sprocket 398 through, for example, a 1:1 reducer 399 is drivingly connected to one of the shafts 191 which has a sprocket 403 keyed thereto to be in driving engagement with an endless chain 412. The chain also extends in engagement with a sprocket 403 keyed to the other shaft 191, sprockets 404 keyed to shafts 148 and idler sprockets 402, 411 which are rotatably mounted by shafts 401, 410 respectively. Shafts 401, 410 are rotatably mounted by plate 141. The sprockets 402, 403, 404 and 411 are located relative to chain 412 such that the shafts 191 are rotated in opposite angular directions whereby the adjacent runs of the chains 415 convey the bag top edges of the bags at station F in a forward direction and the adjacent runs **414*b* of chain 414 (see FIG. 20**) convey the bag top edges at station P in a forward direction.

An air pressure operated clutch 417 provides a driving connection from the shaft 392 to sprocket 419 when air under pressure is applied to the clutch while an overrunning clutch 418 provides a driving connection between shaft 392 and sprocket 420. Drive sprockets 423, 424 are in driving relationship to the input shafts of a reducer 425 while chain 421 forms a drive connection from sprocket 419 to sprocket 423 and chain 422 forms a drive connection from sprocket 420 to sprocket 424. The output of reducer 425 is drivenly connected to the shaft 271, the driven shaft 271 being drivingly connected through a drive chain 430 to drive shaft 233 and to a gear 428 that is keyed thereto. The gear that is keyed to shaft 271 is in intermeshing relationship with a corresponding gear that is keyed to the shaft 272 (see FIG. 23).

Figure 25:
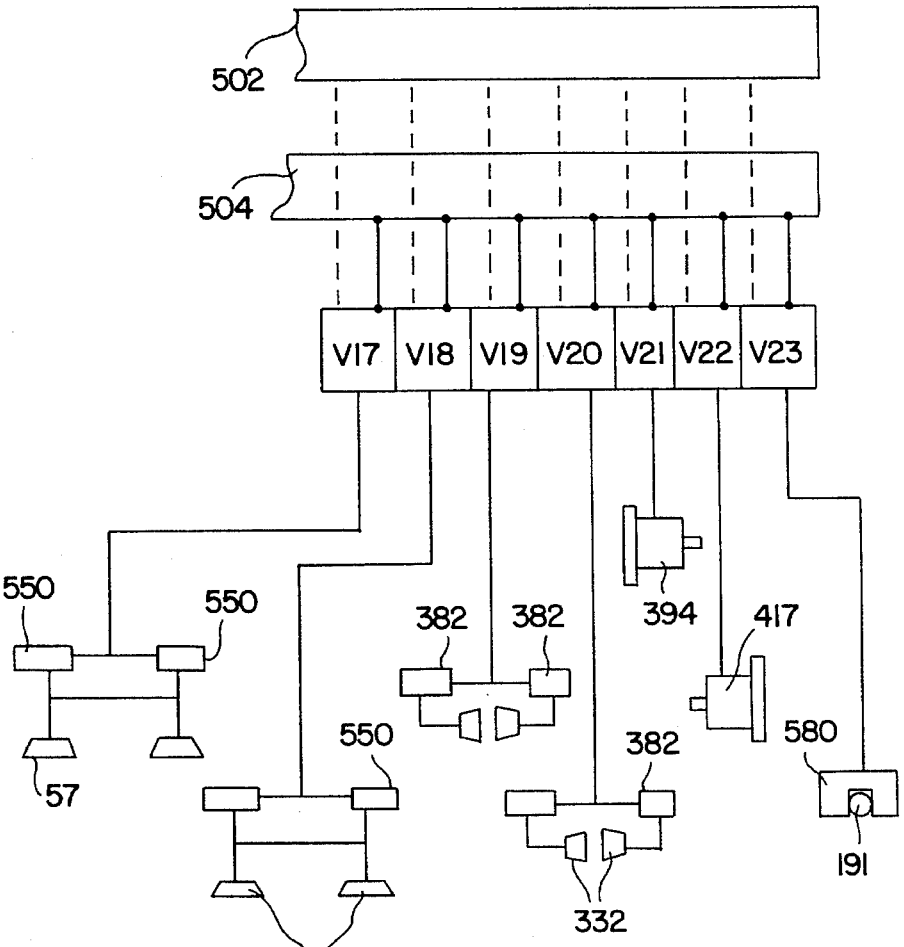
FIGS. 24 and 25 are a schematic showing of controls and components.
Figure 24:
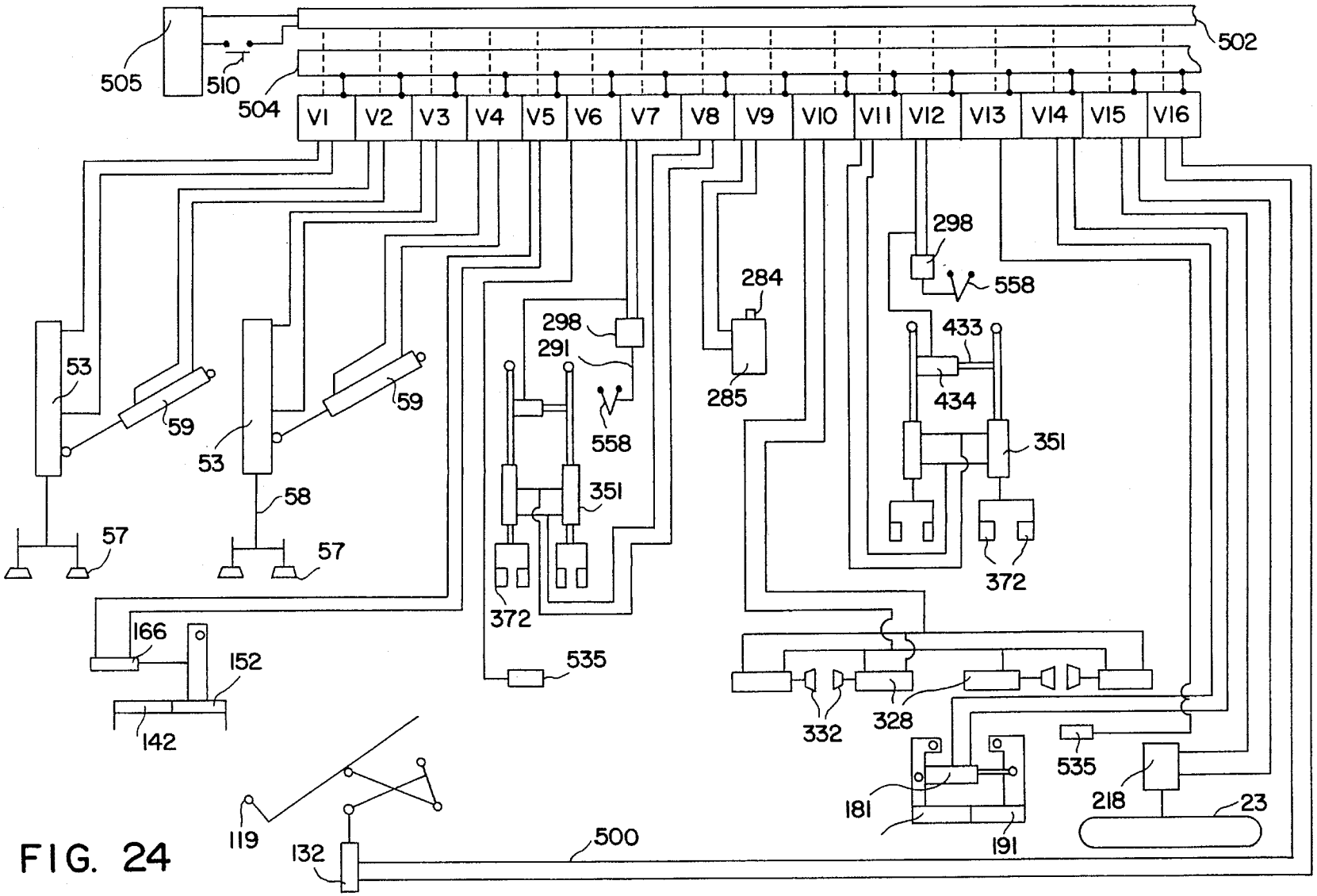

Referring to FIGS. 24 and 25, the pneumatic circuitry, generally designated 500, includes a source of air under pressure 504 and solenoid valves V1–V23 that are connected to the various components such as indicated and to function in a manner that will become more apparent. Advantageously valves VS, V6, VS, V9, V11, V12, V14 and V15 are conventional double solenoid valves while the remaining valves are single solenoid valves. The solenoid valves are controlled by electrical circuitry and components, generally designated 502 and are powered from a power supply 505.

Normally, during initial application of electrical power from the power supply 505, the double acting solenoid valves are in fluid connecting positions so that from valve V9, the piston cylinder combination 285 is in its hopper spout assembly lowered position; from valve V15, the piston cylinder combination 218 is in its conveyor assembly lowered position (assembly 23); from solenoid valves V6, V12, the piston cylinder combinations 291, 298 are in their spout jaw closed position; from solenoid valves V8, V11, the piston cylinder combinations 350, 351 are in their bag clamp pads open position; from solenoid valve V14, the piston cylinder combination 181 for the bag top edge portion conveyor assembly 18 is in its chain closed position; and from solenoid valve V5, the piston cylinder combination 160 for the bag top edge portion conveyor assembly 17 is in its chain closed position.

Referring to FIG. 15, a conventional scale 528 is suitably mounted in fixed relationship to the main frame 11, desirably by structure that is not attached to the frame 11, to be vertically above the hopper spout assemblies 27, 28 for dumping weighted charges of product into the respective assembly. For each assembly 27, 28, a perimetric flange 572 is dependingly joined to the scale and is of a height greater than the vertical distance of movement of the hopper spout assemblies between their datum position and their lowered position. Each hopper spout top portion 275 is of substantially the same cross sectional shape as that of the perimetric flange 572, of a slightly smaller cross sectional area and is of a height to extend into the scale interior even when the assemblies are in their lowered dotted line position of FIG. 15. A horizontal peripheral flange **275*x* is joined to the lower part of portion 275*z* to extend into the space between portion 275*z* and flange 572 for mounting a peripheral seal member 573 to form a seal between members 275*z* and 572 as the hopper spout assemblies 27, 28 move between their positions. It is noted that in view of the transverse dimensions of the arms 278, 339 and that, for example, the approximate vertical distance that the pivots 277 move above and below the elevation of the pivots is about the same, the transverse movement of the assemblies is minimized, this limiting the amount of clearance that has to be provided between flange 275*z* and flange 572**. Advantageously, a flexible, vertical plastic sleeve (not shown) is provided within each spout assembly that extends from above the spout jaws and downwardly to the lower part of the spout jaws to have product flow therethrough and minimize escape of product particles or dust through the area of the pivotal mounting of the jaws to the spout and the sides of the jaws.

If it is desired to decrease the weight of the hopper spout assemblies that is moved by the cylinder 289, parts of the assemblies that are above the hopper spout assembly frame 284, 855 may be fixed to the scale and telescopically extended into the remaining part that is mounted by the frame 284, 285 to move with said frame.

To start operations, a manually operated bag feed switch 510 of the electrical controls 502 is temporarily held in a closed position to initiate the energization of the bag pick up solenoid valves V1, V3 to thereby apply fluid pressure to the piston cylinder combinations 53 to move the vacuum cups downwardly to engage the top bag 20 on the respective bag stack R, S. As the vacuum cups approach the top bag, proximity eyes (not shown) of the electrical controls sense that the cups are close to the top bags and then energize the solenoid coils V17, V18 whereby pressurized air is applied to conventional vacuum transducers 550 that are mounted to the cup mounts for applying a vacuum to the cups, or alternately the solenoids may be connected to a source of vacuum (not shown). For each of the pick up assemblies 12, 14, the bar 54 mounts a photoelectric eye (sensor) 514 which, when moved to be within a preselected distance of the top bag on the stack on the magazine, will result in the respective solenoid valve V1, V3 being energized. Upon the cups engaging the top bag **20*c* on the respective stack R, S, the cups are compressed so that the top bag is located within the preselected distance of the sensor 514 which results in the respective solenoid valve V1, V3 being deenergized. This results in the piston rods 58 being retracted and thereby the top bags being elevated. Adjacent to the end of the elevating step the sensor 517 on plate 50 is engaged, for example by bar 54 (see FIG. 4), and in the event the eye 514 is not still in the preselected distance of a picked up bag as a result of no bag being gripped by the adjacent vacuum cups, the controls 502** energize the respective solenoid valve V1, V3 so that the vacuum cups are again lowered to engage a top bag and then are retracted. If after, for example, three attempts are made and the respective pick up assembly does not elevate a bag, the machine is stopped.

Assuming that each assembly 12, 14 has elevated a bag, upon the bars 54 engaging the sensors 517, the bag feed in solenoid valves V2, V4 are energized whereupon the piston cylinder combinations 59 pivot the mounting plates 50 in the direction of the arrow 519 to feed the bottom end portions of the picked up bags to the entry nips between rollers 72, 109, the rollers 72 being drivenly rotated. This pivotal movement of the piston cylinder combinations 53, 58 continues until the vacuum cups have been swung across the plane of pivot axes of the rollers 72, 109. The electrical controls include a timer (not shown) that times out a preselected period of time after solenoid valves V2, V4 are energized to control the solenoid valves V17, V18 to discontinue the application of vacuum to cups 57.

The vacuum to the pick up cups is discontinued after the picked up bags have entered into the entry nip between the feed and idler rollers, but prior to the complete retraction of the piston rods of the piston cylinder combinations 59. A predetermined time after the mounting plates 50 have completed their pivotal movement in the direction of the arrow 519, the valves V2, V4 are deenergized whereby the combinations 59 pivot the mounting plates back to their datum position. The return of the mounting plates to their datum position actuates a sensor 575 which again energizes valves V1, V2 to again start a cycle of picking up a second pair of bags from stacks R, S. The sensor 575 may be, for example, mounted to the frame member 40 to be actuated by bracket 51.

The two elevated bags are moved by the rollers 72, 109 to fall onto the bag positioner plates and slide to have their bottom edges abut against the stop plates 139. Also, a predetermined period of time after energization of valves V2, V4, which is sufficient for the bags to abut against the stop plates, the above timer breaks a circuit whereby valves V2, V4 are deenergized so that the piston rods of the swing piston cylinder combinations 59 are extended; and then complete a circuit to energize the bag pivot raise solenoid valve V16 so that the bag positioners 93–95 are pivoted from the solid line position of FIG. 2 to the generally upright (near vertical) dotted line position, for example extending at an angle of 85 degrees upwardly and transversely toward the feed rollers. An appropriate sensor 521 is mounted, for example, to bracket 129 to sense the movement of the members which pivot the positioners 93–95 toward their dotted line position to energize the solenoid valve V5 whereby the piston cylinder combination 160 acts to move the flanged plate 152 and the endless chain mounted thereto from the dotted line position of FIG. 2 to the solid line position to close on the bag top edge portions of the two bags on the then near vertical bag positioners. It is noted that as the bags are moved to their near vertical position, the bag top edge portions extend above the then top edges of the positioners 93–95 and are abuttable against the inner run of the chain mounted by the flanged plate 142 to limit the pivotal movement of the bags on the positioners.

An appropriate sensor 552 is mounted, for example, to one of the brackets 149 to be operated by the movement of the respective arm 150 adjacent to the closed position for flanged plate 152 and causes solenoid valve V16 to be deenergized whereby the bag positions pivot back to their datum position. Shortly after sensor 552 being operated, it completes a circuit to energize the bag transfer clutch solenoid valve V21 and deenergize the solenoid valve V23 which results in the air operated brake 580 releasing its braking engagement with the adjacent shaft 191. Energizing valve V21 results in air under pressure being applied to clutch 394 whereby sprocket 395 starts to rotate which results in conveyor assemblies 17, 18, 23 being actuated, the positioners moving sufficiently back toward their datum position prior to the actuation of assemblies 17, 18 so that the plates 94 will not interfere with the forward movement of the bags by chains 143.

Figure 7:
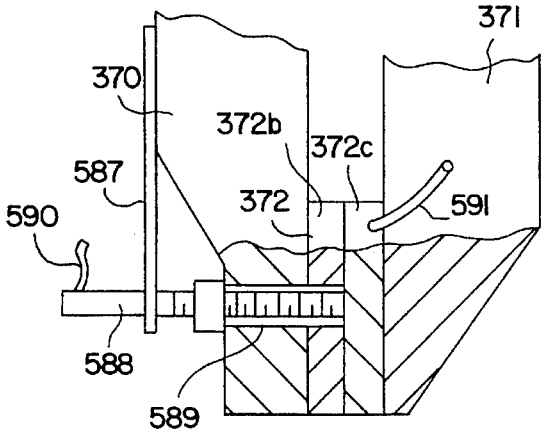
FIG. 7 is an enlarged fragmentary view of the lower end portions of the clamp fingers, parts thereof being shown in cross section.

An encoder 523 is driven by one of the shafts or chains of the conveyor assemblies 17, 18, or the drive therefore, for example, shaft 401, and upon reaching a predetermined count after the start of the drive to assemblies 17, 18, deenergizes valve V21 which results in the discontinuation of the drive to sprocket 395 (transfer clutch 394 disengaged) and the energization valve V23 whereby the brake 580 is actuated to brakingly engage the adjacent shaft 191 to insure that the conveyor assemblies 17–19 and 23 do not overrun. The predetermined count is selected so that when the two bags clampingly engaged by the chains of conveyor assembly 17 have been longitudinally moved from the positions initially engaged by chains 414 to positions the engaged bags are longitudinally centered with the spout jaws of the respective assembly 27, 28 and the leading and trailing bag top edge portions are between the leading and trailing clamp pads 372 of the respective bag hanger assembly, the transfer clutch valve V21 is deenergized whereby the clutch 394 becomes disengaged and valve 23 is energized so that the brake 580 brakingly engages the adjacent shaft 191. Also, a fraction of a second after clutch 394 becoming disengaged, the bag clamp solenoid valves V8, V11 are energized whereby the piston rods 350 are extended so that pads 372 clampingly engage the top corner portions of the bags above the linked chains of conveyor assembly 18. In order to determine whether or not a bag top corner portion is clamped between each set of pads 372, the lower end portion of each finger 370 mounts the upper end portion of a non-electrically conductive, resilient strip 587. The lower end portion of the strip mounts an electrically conductive plunger 588 that extends through an aperture 589 in the finger 370 and a corresponding aperture in pad **372*b* which is mounted to finger 370. The plunger is slideably extended through an insulator ring 592 mounted to the finger 370 and within aperture 589 to retain the plunger out of contact with finger 370 and pad 372*b*. The controls 502 include electric leads 590, 591, lead 590 being electrically connected to plunger 588 and lead 591 to pad 372*c* which is mounted to the lower end portion of finger 371. In the event no bag corner portion is clamped between pads 372*b*, 372*c* are moved to their bag corner clamping position of FIG. 7, an electric circuit is completed that extends through lead 590, plunger 588, pad 372*c* and lead 591. If a bag corner portion is properly clamped between pads 372*b*, 372*c*** no such an electric circuit is completed.

Figure 29:
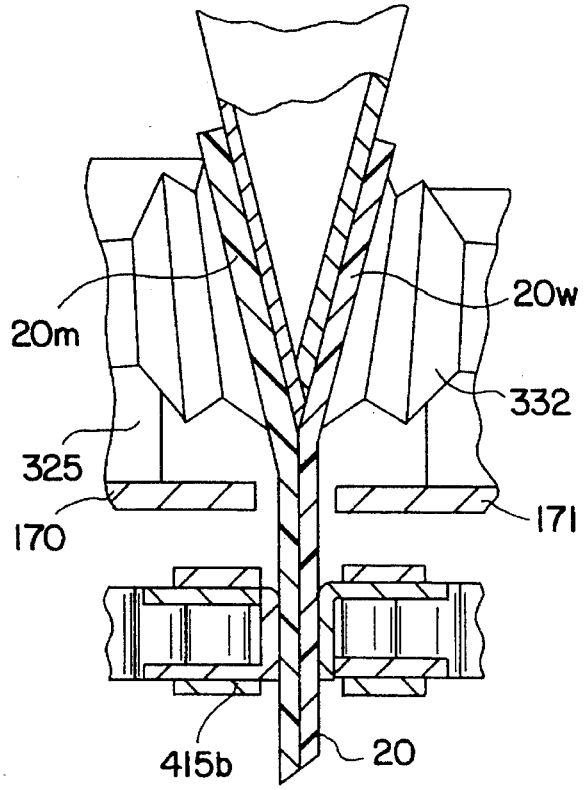
FIG. 29 is a fragmentary transverse view, mostly in cross section just prior to the product being discharged into a bag, said view showing the vacuum cups for spreading the bag top side wall portions in their extended position and the spout jaws in their lowered, closed position extending between the bag top side wall portions.

Simultaneously with solenoid valves V8, V11 being energized, the bag open solenoid valve V10 is energized so that the vacuum cups 332 are moved to their bag top edge portion engaging positions and the valves V19, V20 are energized to apply pressurized air to the vacuum transducers 382 to apply a vacuum to the bag opening cups 332 for the respective spout assembly 27, 28. After a time delay sufficient for the cups 332 to engage the adjacent side wall top edge portions **20*m*, 20*w* (see FIG. 29), valve V10 is deenergized whereby the vacuum cups are retracted and the bag top edge portions which are above the inner runs of chains 415 are spread slightly, but sufficiently for the lower part of the jaws in their closed, lowered position to enter therebetween. Additionally, valve V15 is energized to operate the piston cylinder combination 218 to lower the conveyor belts 208**.

A fraction of a second after the deenergization of the valve V10, the hopper spout lower valve V9 is energized so that the piston rod 279 is retracted to lower the hopper spout assemblies to have the spout jaw lower end portions enter between the adjacent bag top edge portions. As the hopper spout assemblies are lowered, a sensor 525 is actuated, for example the sensor being mounted to an upright 582 to be actuated by arm 278. Advantageously, upright 582 may be mounted to plate 409 adjacent to the end portion of arm 278 which is adjacent to the rear pivot 277.

At the time sensor 525 is actuated and if each spread apart bag top side wall portion extends between the respective sensor member 338 and the adjacent one of jaws 292, 293, for the respective hopper spout assembly 27, 28, the relevant one of the spout open solenoid valves V6, V12 is energized whereby the respective actuator rod 291 is rotated to start the opening of the spout jaws that are controlled thereby and pressurized air is exhausted from cylinders 434 to permit the lower end portions of the mounting plates of each of the hanger assemblies 25, 30 to pivot longitudinally toward one another. Also, at the same time the chain drive solenoid valve V14 is energized, the piston rod of the piston cylinder combination 181 is extended to pivotally move the flange plates 170, 171 and thereby the chains mounted thereon to swing transversely apart to allow the spout jaws open. As a result, the product that had been predumped from the respective scale 528 falls through the opening jaws and into the bags that are clamped by the bag clamps 372. Since the opening of jaws and the spreading of the chains 415 takes place at substantially the same time, the bag is primarily opened by the descending product. Accordingly, there is substantially no chance for a significant volume of air to enter the bag which has to be subsequently displaced by product as occurs in prior art equipment.

The opening of the jaws opens the bag mouth and thus the longitudinal distance between the bag leading and trailing edges **20*h* decreases. This decrease can take place since the piston rods 433 can retract as the bag mouths open, the cylinders 434** being connected to exhaust ports (not shown).

In the event that one of the bag side wall top edge portions is not in a proper position between a spout jaw and the adjacent vacuum cup 332 to have product discharged into the bag, the relevant one of the sensor elements 338 will be in contact with one of the spout jaws at the time the spout down sensor 525 is actuated, or a bag top corner portion is not clamped between each set of pads **372*b*, 372*c* whereby an electric circuit is completed from plunger 588 to pad 372*c*, a circuit is not completed for energizing the respective one of solenoid valves V6, V12, and the respective one of valves V8, V11 is deenergized whereby the clamp pads for that hopper spout spread apart to release the empty bag. Further, at the same time, the appropriate one of the air jet solenoid valves V7, V13 is energized for a sufficient duration to apply pressurized air to its air jet 535**. The resulting air stream is transversely directed toward the lower portion of the clamped released bag (improperly positioned bag) to blow the bag out of the side of the machine so as not to interfere with further operations.

A fraction of a second after the jaws of one or both spouts open, the conveyor raise solenoid valve V15 is energized so that the piston cylinder combination 218 raises the assembly 23 to its datum position to support the bottom of the bag or bags being filled while the bag or bags are still clamped by the clamp pads.

For purposes of further describing the operation, it will be assumed that two bags are simultaneously being filled by the hopper spout assemblies. The electric controls include a timer (not shown) which when timed out deenergizes the valves V6, V12 so that the jaws will close and deenergize valve V9 so that the piston cylinder combination will elevate the spouts to move the jaws up from between the bag top edges and the spouts back to their datum position. The deenergization of valves V6, V12 also result in pressurized air being applied to cylinders 434 to extend their piston rods 433 whereby the clamp pads 372 of each of the assemblies 25, 30 are moved back to their solid line positions of FIG. 27 to move the bag top edge portions to close the bag mouths after the spout jaws have been withdrawn from between the bag top side wall portions. Also, when the last mentioned timer times out, the valve V14 is deenergized which results in the flanged plates 170, 171 pivoting to their datum position such that the chains mounted thereby clampingly engage the bag top edges of the filled bags.

When the spout jaws are moved to their closed positions, the sensors 538 are actuated, and when the hopper spout assemblies are in their up position, the sensor 552 of the conveyor assembly 17 is actuated and the sensor 540 of conveyor assembly 18 is actuated so that the electrical controls deengergize valve V23 so that the brake 580 releases its braking engagement with shaft 191 and an electrical control circuit is completed to again actuate the clutch solenoid valve V21 whereupon clutch 394 is operated to drive sprocket 395 and therethrough the chains of the conveyor assemblies 17, 18 and the belts 208 driven to convey bags forwardly, including the flat folded bags and the filled bags. At this time, the encoder 523 begins its counting as previously described. The actuation of the sensor 548 also results in the scale discharging a predetermined weight of product to fall into the respective hopper spout assembly to be ready for discharging into a bag upon opening of the spout jaws. As an example, the sensors 548 may be mounted to upright 582 to be actuated by an end portion of the adjacent arm 278 when the hopper spouts are returned to their elevated position; the jaw closed sensors 538 are mounted to plates 291 to be actuated by the radial outer ends of the control arms 303 upon the arms being pivoted to their jaw closed position, and the conveyor assembly sensor 540 is mounted to a plate 175 to be actuated by the adjacent arm 173 being moved to its datum position of FIG. 8. The radial inner ends of the control arms 303 are keyed to pivots 320 to move therewith.

The completion of control circuitry to energize the clutch solenoid valve V21 also completes a control circuit to energize the fast feed clutch solenoid valve V22 to operate the air operated clutch 417 to drive sprocket 419 and solenoid valve V23 to discontinue the application of pressurized air to the air operated brake 580 whereby it releases its braking engagement with, for example, one of the shafts 191. This results in the upper runs **231*b* of belts 231 being moved at the same rate of speed as the upper runs of the belts 208. During this period of time the leading bag on the belts is moved to have its bag top edge enter between the chains 413 of conveyor 19 and the filled bag bottom move off belts 208 and onto belt 231. The electrical controls also includes an electric eye 441 mounted to the front of the main frame for sensing movement of a filled bag adjacent to the bag top edge portion and bag bottom conveyor assemblies 545, 547 respectively of a conventional bag sealer machine, generally designated 544, which is at station E. The eye sensing the presence of a bag will deenergize the clutch valve V22 to discontinue the drive through sprocket 419, the overrunning clutch 418 permitting the drive connection 427 to be rotated at a higher rate of speed than when driven through the sprockets 420, 424. When the clutch 417 is disengaged, the overrunning clutch drives sprocket 420 which in turn results in the drive connection 427 being driven at, for example, about half the rate of rotation than that which occurs when the clutch 417 is engaged. When the clutch 417 is disengaged, the rate of movement of the bag by conveyor assemblies 19, 24 is substantially the same as that by the bag top and bag bottom conveyors 545, 547**.

With the above operation, as two filled bags at station F are being conveyed toward station T, two flat folded empty bags are being conveyed by conveyor assembly 17 toward station F. Further, at the time the two bags that were being conveyed by conveyor assembly 17 have been conveyed to be centered beneath the hopper spout assemblies 27, 28, the two filled bags that were at least in part supported by conveyor belts 208 are in part supported by belts 231 in positions such as indicated by dotted lines in FIG. 1. During the conveyance of the bags by conveyor assemblies 17–19, the bags are moved generally linearly. During the time the conveyor assemblies 17, 18, 23 are stopped, the conveyors 231, 250 are operated at a lower rate of speed to continue to move the bags thereon to the bag sealer machine 544. Further, while the hopper spout assemblies are moving down, the jaws opening and the hopper spout assemblies moving up; two bags are being picked up and fed to the positioners and the positioners are moving between its positions. As shown in FIG. 26, the chains of the conveyor assembly 17 are moving to their closed position while the chains of the conveyor assembly 18 are in their open position and prior to the chains of the conveyor assembly moving toward their closed position.

In the event only one of the air jets V7, V13 is energized, the corresponding one of the hopper spout jaws will not open, nor will the scale during the next cycle of operation dump product in said corresponding one of the hopper spout assemblies, but the other set of jaws will open.

Once the bag feed switches have been turned "on", the apparatus continues to operate as may be even more apparent from FIG. 26.

It is to be understood that the sensors referred to herein advantageously are proximity switches but may be limit switches or other appropriate devices for sensing movement. Further, the sensors may be mounted on parts of the apparatus other than as set forth and shown as long as the sensors function as herein described, including in the timed relationship. Thus the electrical controls may include a conventional programmed control sequencer that is programmed to receive inputs furnished by the sensors and provide outputs to operate various control components, including the solenoid valves,to control operations as indicated herein. Even though the sequencer is conventional, the program is not.

It is to be understood that with appropriate controls, the apparatus may be used to pick up a single bag at a time, fill one bag at a time, etc.

What is claimed is:

1. In apparatus for feeding a flat folded bag having opposite side walls, bag top edge portions including opposite first and second corner edge portions defining a bag mouth, a bottom edge, a leading edge and a trailing edge from a bag magazine to a positioner station and thence to a bag filling station, a longitudinally elongated main frame having a rear end and a front end longitudinally spaced from and longitudinally forwardly of the rear end, said positioner station being at the frame rear end and the bag filling station being longitudinally forwardly of the positioner station, pivot means defining a positioner assembly pivot having a pivot axis that extends longitudinally relative to the frame, said pivot means being mounted to the frame, a bag positioner assembly mounted on the pivot means for pivotal movement about the axis of the pivot means between a datum first position inclined upwardly and transversely relative to the pivot means axis to receive a flat folded bag and support the received bag in an inclined position and an at least a nearly vertical second position extending at a substantially greater angle to the horizontal than in its datum position to move the supported bag as the positioner assembly moves to its second position, said positioner assembly in its second position with a flat folded bag thereon having the bag top edge portions extending thereabove, feed means for picking up a bag from the magazine and feeding the picked up, flat folded bag to the positioner assembly while the positioner assembly is in its datum position, a longitudinally elongated bag top first conveyor assembly for receiving the bag from the positioner assembly when the positioner assembly is in its second position and then conveying the bag in a longitudinally forward direction toward the frame front end, the first conveyor assembly including a driven first endless conveyor member at the positioner station and having an elongated inner run extending longitudinally relative to the main frame, means for mounting the first endless conveyor member to the main frame in a position to have the bag top edge portions of the flat folded bag on the positioner assembly abuttable against the first conveyor member inner run when the positioner assembly is in its second position, a driven second endless conveyor member at the positioner station and having an elongated inner run extending longitudinally relative to the main frame, and means for mounting the second conveyor member to the main frame and moving it vertically and transversely relative to the frame between an open position that the flat folded bag on the positioner assembly can be moved by the positioner assembly moving to its second position to have one of the bag top edge portions abut against the first conveyor member inner run and a closed position that the second conveyor member inner run in cooperation with the first conveyor member inner run, engage the bag top edge portions of the bag on the positioner assembly in its second position for moving the flat folded bag in a forward direction from the positioner assembly to the filling station with the major part of the bag depending from the first and second conveyor members' inner runs, the second conveyor member's inner run in the second conveyor member open position being transversely spaced from the first conveyor member's inner run, a first hopper spout assembly at the filling station for discharging product into the bag located therebeneath, means for mounting the hopper spout assembly to the main frame longitudinally forwardly of the first and second conveyor members, and filling station means mounted to the frame for receiving a flat folded bag from the first and second conveyor members, conveying the received bag to a position beneath the hopper spout assembly and cooperating with the hopper spout assembly to spread the bag top edge portions for having product discharged into the bag to fill the bag and thereafter convey the filled bag longitudinally forwardly of the hopper spout assembly, the filling station means including an elongated bag top second conveyor assembly for engaging the bag top edge portions to convey a flat folded bag from the first conveyor assembly to a position beneath the hopper spout assembly and after the bag is filled, engaging the bag top edge portions to move the bag top edges portions of the filled bag forwardly of the hopper spout assembly, the second conveyor assembly including a third endless conveyor member having an elongated inner run, a fourth endless conveyor member having an elongated inner run, and means mounted to the main frame for mounting the third and fourth conveyor members and moving their inner runs between a closed position for engaging therebetween, the bag top edge portions of the bag conveyed to the filling station by the first and second conveyor members to convey the bag longitudinally forwardly to a position beneath the hopper spout assembly to be filled, other than during the bag filling operation, and a transversely spread apart open position permitting the bag being filled.

2. The apparatus of claim 1 further characterized in that the filling station means includes bag hanger assembly means mounted to the main frame for clampingly engaging the top leading and trailing corner edge portions of a bag beneath the hopper spout assembly while the third and fourth members are in their closed position and maintaining the clamping engagement until after the bag is filled and the third and fourth conveyor members have moved back to their closed position, said hanger assembly means including clamp means transversely movable between a spaced apart position to permit the bag top edge portions being longitudinally movable therebetween and a clamped position for clampingly engaging the corner portions, said clamp means including first and second clamp members movable between a clamped position to clampingly engage the first and second bag top corner edge portions respectively and being longitudinally movable toward one another when in their clamped position to permit the spreading apart of the bag top edge portions while product is being discharged into the bag and after the bag is filled and prior to the third and fourth conveyor members moving to their closed position, moving the bag corner edge portions longitudinally away from one another.

3. The apparatus of claim 2 further characterized in that the filling station means includes first and second vacuum cup means mounted to the third and fourth conveyor members respectively for movement with and relative to the respective one of the third and fourth conveyor members from a datum retracted position toward the other to a bag top engage gripping position to grippingly engage the adjacent bag top side wall portion above the third and fourth conveyor members when the bag has moved beneath the hopper spout assembly and the third and fourth conveyor members are in their closed position and thence relative movable away from the other vacuum cup means toward their datum position to spread the bag top edge portions above the third and fourth conveyor members while the third and fourth conveyor members are in their closed position and the corner portions are clampingly engaged by the clamp means, and releasing the vacuum cup means gripping engagement after the bag is filled.

4. The apparatus of claim 3 further characterize in that the hopper spout assembly includes a spout, and a jaw subassembly dependingly mounted to the spout, the subassembly including jaws movable between a closed position preventing the discharge of product through the spout and an open position, and that the hopper spout mounting means includes means for lowering the hopper spout assembly with the jaws in their closed position to enter between the spread bag top edge portions while the third and fourth conveyor members are in their closed position and the vacuum cup means are in their retracted position in gripping engagement with the bag top edge portions, and raising the hopper spout assembly after the bag is filled and that the bag hanger assembly includes means to operate the clamp means to clampingly engage the top leading and trailing corner edge portions of a bag above the third and fourth conveyor members inner runs while the third and fourth conveyors are in a closed position to dependingly support the bag beneath the hopper spout assembly.

5. The apparatus of claim 4 further characterized in that the jaw subassembly includes operable means for moving the jaws to their open position for discharging product into the bag as the third and fourth conveyor members are moving to their open position and that the filling station means includes a third conveyor assembly having a longitudinally elongated endless fifth conveyor member located vertically beneath the second conveyor assembly for supporting a bag as it is being filled and conveying the filled bag longitudinally forwardly, and means for mounting the fifth conveyor member to the main frame for movement between an upper filled bag supporting position and a lowered position.

6. The apparatus of claim 1 wherein the magazine supports a first and a second adjacent stacks of flat folded bags in longitudinal spaced relationship relative to the main frame, further characterized in that the bag positioner assembly includes a first bag positioner and a second bag positioner for respectfully supporting a first and a second flat folded bag when the positioner assembly is in its datum position, said pivot means mounting the bag positioners in longitudinal spaced relationship and in longitudinal alignment with one another, and means for simultaneously pivoting the bag positioners between the bag positioner assembly positions, the positioners having top edges and when supporting bags in the positioner assembly datum position, having the bags top edge portions extending to a higher elevation than the positioners top edges, and that the feed means includes a flat folded first bag pick up assembly for removing a first bag from the first stack and feeding the first bag toward the first bag positioner and a second pick up assembly mounted to the main frame for removing a flat folded second bag from the second stack and feeding the second bag to the second bag positioner, the first and second conveyor members being of longitudinal lengths to simultaneously conveying the flat folded first and second bags to the filling station means after the bag positioners with bags thereon have been moved to the positioner assembly second position.

7. The apparatus of claim 6 further characterized in that there is provided a second hopper spout assembly mounted to the hopper spout assembly mounting means for movement therewith, said second hopper assembly being mounted in longitudinal alignment with the first hopper assembly and in substantially the same longitudinal spaced relationship as the longitudinal spacing of the bag positioners, the filling station means receiving the second bag from the first conveyor assembly and conveying it to a position beneath the second hopper spout assembly while the first bag is being conveyed beneath the first hopper assembly and cooperating with the second hopper spout assembly for discharging product into the second bag and thereafter convey the filled second bag longitudinally forwardly of the hopper spout assemblies.

8. The apparatus of claim 7 wherein there is a transfer station located on the frame longitudinally forwardly of the filling station and in longitudinal alignment with the filling station and the first conveyor assembly, further characterized in that the second conveyor assembly extends forwardly to the transfer station, that the filling station means includes an endless bag bag bottom filling station conveyor assembly at the filling station for acting in cooperation with the second conveyor assembly to convey the filled first and second bags from beneath the hopper spout assemblies to the transfer station, and that there is provided endless bag top and bag bottom transfer conveyor assemblies mounted on the frame at the transfer station for receiving the filled bags from the filling station bag bottom conveyor assembly and the second conveyor assembly, and means for simultaneously driving the first, second, third and fourth conveyor members, the filling station bag bottom assembly and the bag top and bag bottom transfer conveyors assemblies after the first and second endless conveyor members have been moved to their closed position and the bags, if any, below the hopper spout assemblies have been filled, and the bag bottom and bag top transfer conveyor assemblies at the same rate of speed, and discontinue the drive to the first, second, third and fourth conveyor members and the filling station bag bottom conveyor assembly when the positioner assembly is in its second position and the bags are being filled while continuing the drive to the bag top and bag bottom transfer conveyor assemblies at a substantial lower rate of speed than when the first, second, third and fourth conveyor members and the filling station bag top and bag bottom conveyor assemblies are being driven.

9. The apparatus of claim 7 further characterized in that the second longitudinally elongated conveyor assembly extends longitudinally for conveyingly engaging the bag top edge portions of the second bag to convey the second bag from the first conveyor assembly to a position beneath the second hopper spout assembly as the first bag is being conveyed beneath the first hopper spout assembly, and after the bags are filled, engaging the bag top edge portions of the second bag for conveying filled bags longitudinally forwardly of the hopper spout assemblies, and that the filling station means includes a first and a second bag hanger assembly mounted to the main frame adjacent to the first and second hopper spout assembly respectively for clampingly engaging the leading and trailing top corner edge portions of a bag beneath the respective hopper spout assembly while the third and fourth conveyor members are in their closed position and maintaining the clamping engagement until after the bags are filled and the third and fourth conveyor members move back to their closed position, each hanger assembly including first and second clamp means movable to a release position to permit the bag top edge portions being longitudinally movable adjacent thereto by the third and fourth conveyor means in their closed position, and a clamped position to clampingly engage the first and second corner portions of the bag beneath the respective hopper spout assembly, and means mounting the first and second clamp means for longitudinally movement toward one another when in their clamped position to permit the spreading apart of the bag top edge portions while product is being discharged into the respective bag and thence movement of the bag corner edge portions longitudinally away from one another after the bags are filled and prior to the third and fourth conveyor members moving to their closed position, that the filling station means includes vacuum cup means mounted to each of the third and fourth conveyor members for movement therewith and relative thereto to a bag top engage gripping position to grippingly engage the adjacent bag top side wall portion when the first and second bag has moved beneath the first and second hopper spout assembly respectively and thence movable away from the vacuum cup means on the other of the third and fourth conveyor members respectively to a datum position to spread the bag top edge portions above the third and fourth conveyor members while the third and fourth conveyor members are in their closed position and the corner portions are clampingly engaged, and releasing the gripping engagement after the bag is filled, that each hopper spout assembly includes a spout and a jaw subassembly dependingly mounted to the spout, each jaw subassembly including spout jaws movable between a closed position preventing the discharge of product through the spout and an open position, and that the hopper spout mounting means includes means for lowering the hopper spout assemblies with the jaws in a closed position to enter between the respective spread apart bag top edge portions while the third and fourth conveyor members are in their closed position and the vacuum cup means are in their gripping engaging position and raising the hopper spout assemblies after the bags are filled.

10. The apparatus of claim 9 further characterized in that there is provided first and second jet means for transversely directing a jet of air against the bag that is being clampingly engaged by the respective bag hanger assembly, said jets of air being directed against the respective bag below the second conveyor assembly, and means for operating the respective jet means to discharge a jet of air against a bag beneath one of the hopper spout assemblies and operate the relevant one of the hanger assemblies to release its clamping engagement and, in the event that after the hopper spout assemblies have been lowered, one of the bag top edge portions of a bag that is beneath one of the hopper spout assemblies is out of proper relationship relative to the hopper spout assembly that the last mentioned bag is beneath for being filled and retain the jaws of the hopper spout assembly that has the bag top corner portion out of proper relationship thereto in a closed position even while the jaws of the other hopper spout assembly are opened.

11. The apparatus of claim 1 wherein the positioner assembly comprises a positioner having an elongated bag support for slidably receiving a flat folded bag and support the received bag, means mounting the bag support to the pivot means for pivotal movement about said axis between a datum first position inclined upwardly and transversely relative to the frame to receive a flat folded bag from the feed means, have the bag slide thereon and support the received bag in an inclined position, and a nearly vertical second position extending at a substantially greater angle to the horizontal than in the datum position to have the bag thereon extend above the bag support in a position abuttable against the inner run of the first conveyor member when the second conveyor member is in its second position, means mounted to the frame for pivoting the bag support between the bag support positions and a stop member mounted to the bag support to limit the sliding movement of the bag on the bag support when the bag support is in its datum position.

12. The apparatus of claim 1 further characterized in that there is provided control means for operating the means for moving the second conveyor from its open position toward its closed position while the third and fourth conveyors are in their open position and prior to the third and fourth conveyors moving toward their closed position.

13. In apparatus for feeding a pair of flat folded bag that each has opposite side walls, bag top edge portions including opposite first and second corner edge portions defining a bag mouth, a bottom edge, a leading edge and a trailing edge from adjacent first and second stacks of flat folded bags on a bag magazine to a positioner station, and convey a pair fed bags to a filling station which is forwardly of the positioner station, thence to a bag transfer station which is forwardly of the positioner station, and thereafter to a discharge station, a longitudinally elongated main frame having a rear end and a front end longitudinally spaced from and longitudinally forwardly of the rear end, means for transferring a first and second bag from the first and second stacks respectively to the positioner station in a flat folded condition in longitudinal spaced relationship to extend at least nearly vertically with their top edges portions being above their bottom edges, a longitudinally elongated, bag top edge portion first conveyor assembly for engaging the bag top edge portions of the first and second bags that are at the positioner station and conveying both of the bags forwardly at the same time in depending relationship from the positioner station to the filling station, the first conveyor assembly including a first and a second conveyor, each of the first and second conveyors having a drivable endless conveyor member that has an elongated inner run for cooperation with the inner run of the other to convey the flat folded bags longitudinally forwardly from the positioner station, and means for mounting the first and second conveyors to the main frame and moving one of the first and second conveyors relative to other between an open spread apart position to permit the bag top edge portions of the first and second bags being moved at the same time between the inner runs of the first and second conveyors, and after the bag top edge portions have been moved between the inner runs of the first and second conveyors, move the first and second conveyors to a closed position for simultaneously conveying the two bags in longitudinal alignment toward the filling station, a first and second hopper spout assembly for discharging product into the first and second bag respectively, means for mounting the hopper spout assemblies to the main frame in alignment at the filling station, a bag top edge portion second conveyor assembly at the filling station for receiving the first and second flat folded bags from the first conveyor assembly and conveying the received pair of bags to positions beneath the first and second hopper spout assemblies respectively to be filled and thence, at least in part, conveying the pair of filled bags to the transfer station, the second conveyor assembly including a third and a fourth conveyor, each of the third and fourth conveyors having a drivable endless conveyor member that has a longitudinally elongated inner run for engaging the adjacent bag top edge portions of the bags received from the first conveyor assembly and cooperate with the inner run of the third and fourth conveyors for moving the received bags to a position beneath the first and second hopper spout assembly respectively to be filled, and means for mounting the third and fourth conveyors to the main frame and moving at least one of the third and fourth conveyors relative to other between an open spread apart position when the received pair of bags are beneath the hopper spout assemblies to permit the received bags being filled, and after the bags are filled, move the third and fourth conveyors to a closed position for their inner runs simultaneously aiding in conveying the two filled bags in longitudinal alignment to the transfer station, a drivable third conveyor assembly at the filling station for supporting the bag bottoms of the filled bags and supportingly conveying the filled bags to the transfer station, means at the filling station for cooperating with the hopper spout assemblies and the third and fourth conveyors to spread the bag top side wall portions of the bags beneath the hopper spout assemblies to facilitate the filling of the bags, a drivable bag bottom fifth conveyor and a sixth drivable bag top edge portion conveyor mounted on the main frame at the transfer station for longitudinally transferring filled bags from the second and third conveyor assemblies to the discharge station, each of the third conveyor assembly and the fifth and sixth conveyors having a drivable endless conveyor member, the discharge station being longitudinally forwardly of the transfer station, and drive means for simultaneously driving the endless drivable conveyor member of the first, second, third, fourth, fifth and sixth conveyors and the third conveyor assembly at a given speed to move two flat folded bags from the positioner station to a position beneath the spouts and at the same time move two filled bags from the filling station to the transfer station, and after the two filled bags have been conveyed to the fifth and sixth conveyor, discontinue the drive to the first, second, third and fourth conveyors and the third conveyor assembly while the third and fourth conveyors are being moved between their opened and closed positions and are in their open position and continue the drive to the fifth and sixth conveyors at a substantially slower speed than said given speed while the drive to the first, second, third and fourth conveyors and the third conveyor assembly has been discontinued.

14. The apparatus of claim 13 further characterized in that the first and second hopper spout assembly includes a first and a second jaw subassembly respectively, each jaw subassembly including a first and second spout jaws having transversely converging side walls that form a bottom apex for selectively controlling the discharge from the respective hopper spout assembly, a first and a second bag hanger assembly mounted to the frame for clampingly engaging the bag top corner portions of the first and second bags that have been moved by the third and conveyors beneath the first and second spout jaws respectively prior to the third and fourth conveyor being relatively moved to their open position, and releasing the clamping engagement after the first and second bag is filled and the third and fourth conveyers have moved back to engage the bag top edge portions for conveying the bag top edge portions of the filled bags forwardly, the means for cooperating with hopper spout assembly and the third and fourth conveyors including first and second vacuum means mounted to the third and fourth conveyor respectively to move with and relative to the respective one of the third and fourth conveyor between a datum retracted position and an extended position to grippingly engage the adjacent bag top edge portion above the inner runs of the third and fourth conveyors when the third and fourth conveyors are in their closed position and a first and a second bag is beneath the first and second jaws respectively and to spread the gripping engaged bag top top edge portions apart as, at least one of, the vacuum cup means are moving to their retracted position, and the third and fourth conveyors are moving to their spread apart position, and releasing the gripping engagement after product has been discharged into the bags, operable means for mounting the hopper spout assemblies to the main frame for vertical movement between a raised datum position and a lowered position having the apex portions enter between the spread apart top edge portions prior to the third and fourth conveyors moving apart, the hopper spout assemblies including means for moving the jaws to their open position after the hopper spout assemblies have been moved to their lowered position and as the third and fourth conveyors are moving apart to discharge product to open the bag extending therebeneath.

15. The apparatus of claim 13 further characterized in that there is provided bag sealing mechanism for receiving filled bags from the fifth and sixth conveyors, the bag sealer mechanism including bag top edge portion and bag bottom conveyors and that the drive means includes means for sensing the movement of the first of the two filled bags being conveyed by the fifth and sixth conveyors adjacent to the bag sealer mechanism conveyors for changing the drive from the given speed to the slower speed.

16. Apparatus for removing a first flat folded bag having opposite side wall top edge portions that includes opposite corner edge portions defining a bag top peripheral edge and a bag mouth, a bottom edge, a leading edge and a trailing edge from a bag magazine and filling a bag with a product, comprising a longitudinally elongated main frame having a rear end and a front end longitudinally spaced from and longitudinally forwardly of the rear end, a first hopper spout assembly having a spout and spout jaws dependingly mounted to the spout for pivotal movement about longitudinal axes between a closed position to block discharge of product therethrough and an open position permitting discharge of product therebetween, said jaws having side walls that transversely converge in a downward direction to provide a bottom apex in a closed position, endless bag top conveyor means mounted on the main frame for engaging the top edge portions of the flat folded bag to convey the flat folded bag to a position beneath the spout jaws and after the bag is filled, retain the bag top edge portions in a closed condition as the filled bag is moved forwardly of the hopper spout assembly, said conveyor means including drivable first and second longitudinally elongated endless conveyor members extending both forwardly and rearwardly of the hopper spout assembly and beneath the jaws in their closed position, each of the conveyor members including a longitudinally elongated inner run adjacent to the other, means mounted to the main frame for mounting the conveyor members and moving the conveyors members between a closed position that the inner runs engage the opposite bag top side wall portions below the bag top peripheral edge for retaining the bag top edge portions in a bag closed, abutting relationship and conveying the bag top edge portions forwardly, and an open spread apart position permitting the bag being filled with product, a first bag hanger assembly mounted to the frame for clampingly engaging the bag top corner portions of a bag beneath the spout jaws prior to the conveyor members being moved to their open position, and releasing the clamping engagement after the bag is filled and the conveyer members have moved back to their closed position to engage the bag top edge portions and move the bag top edge portions forwardly, first and second vacuum means mounted to the first and second conveyor member respectively to move with the respective conveyor member and relative to the respective conveyor member between a datum retracted position and an extended position to grippingly engage the adjacent bag top edge portion above the inner runs when the first and second conveyor members are in their closed position and a bag is beneath the jaws, and to spread the bag top edge portions above the conveyor member inner runs apart during the retraction of the vacuum cup means from their extended position in gripping engagement with the bag top edge portions, and releasing the gripping engagement when product has been discharged into the bag, operable means for mounting the hopper spout assembly to the main frame for vertical movement between a raised datum position and a lowered position having the apex portion of the spout jaws enter between the spread apart bag top edge portions prior to the conveyor members moving away from their closed position toward their open spread apart position, the hopper spout assembly including means for moving the jaws to their open position after the hopper spout assembly has moved to its moved lowered position and as the conveyor members are moving apart to discharge product to open the bag extending therebeneath, and control means for operating the operable means to lower the hopper spout assembly prior to the first and second conveyor members moving to their open position and after the vacuum cup means have spread the grippingly engaged bag top edge portions.

17. The apparatus of claim 16 further characterized in that there is provided control means for operating the operable means to lower the hopper spout assembly prior to the first and second conveyor members moving to their open position and after the vacuum cup means have spread the grippingly engaged bag top edge portions.

18. The apparatus of claim 16 further characterized in that the hanger assembly includes first and second elongated mounting members that extend generally vertically and have upper end portions and lower end portions, means mounted to the main frame for mounting the first and second mounting members upper end portions respectively longitudinally forwardly and rearwardly of the hopper spout assembly for pivotal movement about axes transverse relative to the elongation of the frame to have their lower end portions move between a datum spread apart position and a second position more closely adjacent to one another than in their datum position, first and second clamp finger members mounted to each mounting member for pivotal movement between bag top corner clamping positions with the bag corner portions therebetween and a bag top corner portion release position to permit the bag top edge portions being conveyed therebetween by the conveyor members in the conveyor member closed position, said finger members having upper end portions pivotally mounted to the mounting members, operable means mounted to each of the mounting members to move therewith and relative thereto for moving the respective clamp finger members from their release position to their clamping position after the flat folded bag has been conveyed beneath the spout jaws and prior to the vacuum cup means spreading the bag top edge portions to the bag top edge portions spread apart condition, and to their release position after the bag has been filled and the conveyor members have moved back to their closed position, and means for pivoting the mounting members to move their lower end portions to their spread apart datum position after a bag has been filled and prior to the clamping fingers moving to their release position and permitting the mounting member lower end portions moving more closely adjacent to one another than their datum position when the conveyor members move to their open position and the bag is filled with product.

19. The apparatus of claim 18 wherein a second flat folded bag is conveyed by the conveyor members longitudinally adjacent to the first mentioned bag, said second bag having opposite side wall top edge portions that include opposite corner edge portions defining a bag top peripheral edge and a bag mouth, a bottom edge, a leading edge and a trailing edge, further characterized in that there is provided a second hopper spout assembly mounted by the hopper spout assembly mounting means in longitudinal alignment with the first hopper spout assembly for movement therewith, that the second hopper spout assembly has second spout jaws moveable between a closed position and an open position and in their closed position, have a bottom apex, the conveyor members conveying the first and second flat folded bags to positions beneath the first and second hopper spout assemblies respectively and cooperating with the second hopper spout assembly for discharging product into the second bag to fill the second bag and thereafter convey the filled second bag longitudinally forwardly of the hopper spout assemblies, and a second bag hanger assembly mounted to the frame for clampingly engaging the bag top corner portions of the second bag when the second bag is beneath the second spout jaws and prior to the conveyor members being moved to their open position, and releasing the clamping engagement with the second bag when the second bag is filled and the conveyer members have moved back to their closed position to engage the bag top edge portions of the second bag and move the bag top edge portions of the second bag forwardly, and third and fourth vacuum means mounted to the first and second conveyor member respectively to move with and relative to the respective conveyor member between a datum retracted position and an extended position to grippingly engage the adjacent bag top edge portion of the second bag above the inner runs when the first and second conveyor members are in their closed position and the second bag is beneath the second spout jaws, and to spread the bag top edge portions of the second bag apart prior to the conveyor members moving to their spread apart position, and releasing the gripping engagement when product has been discharged into the second bag to fill the second bag.

20. In apparatus for feeding a flat folded bag having opposite side walls, bag top edge portions including opposite bag top first and second corner edge portions defining a bag mouth, a bottom edge, a leading edge and a trailing edge from adjacent first and second stacks of flat folded bags on a bag magazine to a positioner station, and convey the first and second fed bags to a filling station which is forwardly of the positioner station and thence to a bag transfer station which is forwardly of the positioner station, and thereafter to a discharge station which is forwardly of the transfer station, a longitudinally elongated main frame having a rear end portion and a front end portion longitudinally spaced from and forwardly of the rear end portion, the positioner station being at the rear end portion of the frame and the transfer station being at the front end portion of the frame, means for feeding a first and second bag from the first and second stacks respectively to the positioner station in a flat folded condition in longitudinal spaced relationship relative to the frame, a pivot member mounted to the frame at the positioner station and having a pivot axis extending longitudinally relative to the frame, a bag positioner assembly mounted to the pivot member for pivotal movement about said axis between a datum first position inclined upwardly and transversely relative to the pivot axis to receive the first and second flat folded bags from the feed means and support the received bags in longitudinal spaced relationship, and at least a nearly vertical second position extending at a substantially greater angle to the horizontal than the datum position to move the first and second flat folded bag to a nearly vertical position and have the bag top edges of the received first and second bags extend thereabove, a longitudinally elongated, bag top edge portion first conveyor assembly for engaging the bag top edge portions of the first and second bags on the positioner assembly in its second position and simultaneously conveying both of the bags in depending relationship from the positioner station to the filling station, the first conveyor assembly including a first and a second conveyor, each of the first and second conveyors having a drivable endless conveyor member that has an elongated inner run for cooperating with the inner run of the other of the first and second conveyors to convey the flat folded bag forwardly from the positioner station, and means for mounting the first and second conveyors to the main frame and moving one of the first and second conveyors relative to other between an open spread apart position to permit the bag top edge portions of the first and second bags being moved at the same time to extend between the inner runs of the first and second conveyors by the positioner assembly moving to the positioner assembly second position, and after the bag top edge portions have been moved between the inner runs of the first and second conveyors, move the first and second conveyors to a closed position for conveying the first and second bags toward the filling station, first and second hopper spout assemblies that are operable between an open position for discharging product into the first and second bag respectively and a closed position, means for mounting the hopper spout assemblies to the main frame in alignment at the filling station, a bag top edge portion second conveyor assembly at the filling station for receiving the first and second flat folded bags from the first conveyor assembly and conveying the received first and second bags to positions beneath the first and second hopper spout assemblies respectively to be filled and thence, at least in part, conveying the pair of filled bags to the transfer station, the second conveyor assembly including a third and a fourth conveyor, each of the third and fourth conveyors having a drivable endless conveyor member that has a longitudinally elongated inner run for engaging the adjacent bag top edge portions of the bags received from the first conveyor assembly and cooperate with the other of the third and fourth conveyor for moving the received bags to a position beneath the first and second hopper spout assembly respectively, and means for mounting the third and fourth conveyors to the main frame and moving at least one of the third and fourth conveyors relative to other between a closed position for conveying flat folded bags from the first and second conveyors to a position beneath the hopper spout assemblies and an open spread apart position when the received pair of bags are beneath the hopper spout assemblies to permit the received bags being filled, and after the bags are filled, move the third and fourth conveyors to their closed position for their inner runs simultaneously conveying the bag top edge portions of the two filled bags in longitudinal alignment to the transfer station, a drivable third conveyor assembly at the filling station for supporting the bag bottoms of the first and second filled bags and supportingly conveying the filled bags to the transfer station, operable means at the filling station for cooperating with the hopper spout assemblies and the third and fourth conveyors for engaging and spreading the adjacent the bag top edge portions of the bags beneath the hopper spout assemblies to facilitate the filling of the bags, the means for mounting the first and second hopper spout assemblies including means for moving the hopper spout assemblies between a datum upper position and a lowered position to discharge product into the two bags beneath the respective hopper spout assembly, and first operating means for operating (a) the feeding mean, the positioner assembly, the means for moving the first and second conveyors and the means for moving at least one of the third and fourth conveyors to transfer the first and second bag from the bag magazine to a position beneath the first and second hopper spout assembly, (b) the hopper spout assemblies, the means for moving the hopper spout assemblies, and the means to engage and spread the bag top side wall portions and the means for moving at least one of the third and fourth conveyors to fill the two bags beneath the hopper spout assemblies, (c) the means for moving the third and fourth conveyors and the third conveyor assembly to convey the first and second filled bags toward the transfer station as two flat folded bags are being conveyed by the first and second conveyors toward the filling station, and (d) the means for operating the hopper spout assemblies moving means to move the hopper spout assemblies to their lowered position while the third and fourth conveyors are in their closed position, the first operating means including means for simultaneously driving the first, second, third and fourth conveyors when the first, second, third and fourth conveyors are in their closed condition and discontinue the drive to the first, second, third and fourth conveyors upon both of the first and second flat folded bags have been conveyed by the first and second conveyors to the third and fourth conveyors and the third and fourth conveyor have conveyed first and second flat folded bags to positions beneath the hopper spout assemblies, and means for operating the positioner assembly from its inclined position to its second position to move the first and second bags that are thereon for being abuttable against the inner run of one of the first and second conveyors when the first and second conveyors are in their relative member open position to limit the pivotal movement of bags on the positioner assembly.

21. The apparatus of claim 20 further characterized in that the means for engaging and spreading the adjacent bag top edge portions includes first and second vacuum cup means mounted to the third and fourth conveyors respectively for movement with the respective conveyor and relative to the respective one of the third and fourth conveyor from a datum position relative to the respective conveyor to a bag top engage gripping position to grippingly engage the adjacent bag top edge portion when the first and second bag has moved beneath the first and second hopper spout assembly respectively and the third and fourth conveyors are in their closed position and thence movable away from the vacuum cup means on the other of the third and fourth conveyor respectively to return to their datum position while the third and fourth conveyor members are in their closed position to spread the bag top edge portions of the adjacent bag apart, that each of the hopper spout assemblies includes a pair of jaws that are operable between an open position and a closed position that the jaws converge to form a bottom jaw apex, that there is provided a drivable bag bottom fifth conveyor and a sixth drivable bag top edge portion conveyor mounted on the main frame at the transfer station for longitudinally transferring filled bags from the second and third conveyor assemblies to the discharge station and that the operating means includes means for operating the operable means to lower the hopper spout assemblies to have the jaw apex of enter the spread apart bag top edge portions when the third and fourth conveyors are in their closed position and the first and second bags are beneath the first and second hopper spout assembly respectively.

* * * * *